US006408019B1

(12) United States Patent
Pickering et al.

(10) Patent No.: US 6,408,019 B1
(45) Date of Patent: Jun. 18, 2002

(54) SYSTEM AND METHOD FOR COMMUNICATION USING NOISE

(75) Inventors: Leslie W. Pickering; Jeffrey A. Aaron, both of Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 0 days.

(21) Appl. No.: 09/220,488

(22) Filed: Dec. 23, 1998

Related U.S. Application Data

(60) Provisional application No. 60/068,890, filed on Dec. 29, 1997.

(51) Int. Cl.[7] ..... H04K 1/02

(52) U.S. Cl. ..... 375/200; 375/208; 375/209; 375/210

(58) Field of Search ..... 375/200, 208, 375/209, 210; 455/209

(56) References Cited

U.S. PATENT DOCUMENTS

| | | | | |
|---|---|---|---|---|
| 2,530,140 | A | 11/1950 | Atkins | 250/6 |
| 3,731,197 | A | 5/1973 | Clark | 325/32 |
| 3,761,817 | A | 9/1973 | Kaltschmidt et al. | 325/37 |
| 3,824,467 | A | 7/1974 | French | 325/32 |
| 3,921,151 | A | 11/1975 | Guanella | 340/172.5 |
| 3,978,288 | A | 8/1976 | Bruckner et al. | 179/1.5 R |
| 4,070,693 | A | 1/1978 | Shutterly | 358/123 |
| 4,160,123 | A | 7/1979 | Guanella et al. | 179/1.5 R |
| 4,176,316 | A | 11/1979 | DeRosa et al. | 325/32 |

(List continued on next page.)

OTHER PUBLICATIONS

Bello, Phillip, "Demodulation of a Phase–Modulated Noise Carrier," IRE Transactions on Information Theory, vol. IT–7, No. 1, Jan. 1961, pp. 19–27.

*Primary Examiner*—Thomas R. Peeso
(74) *Attorney, Agent, or Firm*—Thomas, Kayden, Horstemeyer & Risley, LLP

(57) ABSTRACT

Disclosed is a noise communication system and method. The noise communication system comprises a transmitter and a receiver. The transmitter indexes through at least two noise records which comprise a series of randomly generated samples, the noise records being divided into noise segments, to maintain a current noise segment for each noise record. The transmitter modulates a predefined base signal using the segments of the noise records to represent the symbols of the base signal. In modulating the predefined base signal, the transmitter replaces the respective symbols of the base signal with the current noise segments from the noise records, thereby generating a noise signal in which the symbols can not be discerned. The noise signal is transmitted across a communications channel to the receiver which demodulates the noise signal into the base signal. The demodulation employs a number of correlators that equals the number of noise records employed at the transmitter. The receiver includes logic to index through the noise records in a similar manner to the transmitter to produce the current noise segments. Each correlator performs a multiplication function between a current noise segment from the noise record assigned to the correlator and the received segments of the noise signal which reveals a peak output when the segments match. The base signal is recreated by incorporating the symbol indicated by the noise record for which a match was experienced.

43 Claims, 12 Drawing Sheets

U.S. PATENT DOCUMENTS 4,179,658 A 12/1979 Bitzer ..... 325/34
4,301,530 A 11/1981 Gutleber ..... 370/18
4,393,276 A 7/1983 Steele ..... 179/1.5 R
4,397,034 A 8/1983 Cox et al. ..... 455/30
4,425,642 A 1/1984 Moses et al. ..... 370/76
4,607,375 A 8/1986 Lee ..... 375/2.2
4,658,436 A 4/1987 Hill ..... 380/31
4,663,500 A 5/1987 Okamoto et al. ..... 380/47
4,688,257 A 8/1987 Erickson ..... 370/48
4,706,286 A 11/1987 Sturza ..... 380/34
4,743,906 A 5/1988 Fullerton ..... 342/27
4,805,216 A 2/1989 Gruenberg ..... 380/21
4,977,578 A 12/1990 Ishigaki et al. ..... 375/1
5,048,052 A 9/1991 Hamatsu et al. ..... 375/1
5,058,128 A 10/1991 Kurihara et al. ..... 375/1
5,204,903 A 4/1993 Okada et al. ..... 380/46
5,274,665 A 12/1993 Schilling ..... 375/1
5,291,202 A 3/1994 McClintock ..... 342/16
5,291,555 A 3/1994 Cuomo et al. ..... 380/6
5,293,398 A 3/1994 Hamao et al. ..... 375/1
5,329,547 A 7/1994 Ling ..... 375/1
5,404,394 A 4/1995 Dimolitsas et al. ..... 379/100
5,438,589 A 8/1995 Nakamura ..... 375/200
5,459,758 A 10/1995 Moore, III ..... 375/200
5,493,612 A 2/1996 Klund et al. ..... 380/6
5,533,046 A 7/1996 Lund ..... 375/200
5,539,775 A 7/1996 Tuttle et al. ..... 375/200
5,546,424 A 8/1996 Miyake ..... 375/206
5,559,828 A 9/1996 Armstrong et al. ..... 375/200
5,561,686 A 10/1996 Kobayashi et al. ..... 375/200
5,563,906 A 10/1996 Hershey et al. ..... 375/200
5,568,508 A 10/1996 Hershey ..... 375/200
5,574,747 A 11/1996 Lomp ..... 375/200
5,583,850 A 12/1996 Snodgrass et al. ..... 370/345
5,583,884 A 12/1996 Maruyama et al. ..... 375/207
5,596,599 A 1/1997 Saito ..... 375/200
5,604,765 A 2/1997 Bruno et al. ..... 375/200
5,604,766 A 2/1997 Dohi et al. ..... 375/200
5,604,767 A 2/1997 Dixon et al. ..... 375/206
5,606,574 A 2/1997 Hasegawa et al. ..... 375/200
5,615,226 A 3/1997 Lipa ..... 375/200
5,619,524 A 4/1997 Ling et al. ..... 375/200
5,621,752 A 4/1997 Antonio et al. ..... 375/200
5,623,487 A 4/1997 Natali ..... 370/342
5,625,639 A 4/1997 Tomita et al. ..... 375/200
5,629,929 A 5/1997 Blanchard et al. ..... 370/201
5,631,921 A 5/1997 Schilling ..... 375/200
5,657,379 A 8/1997 Honda et al. ..... 379/93.28

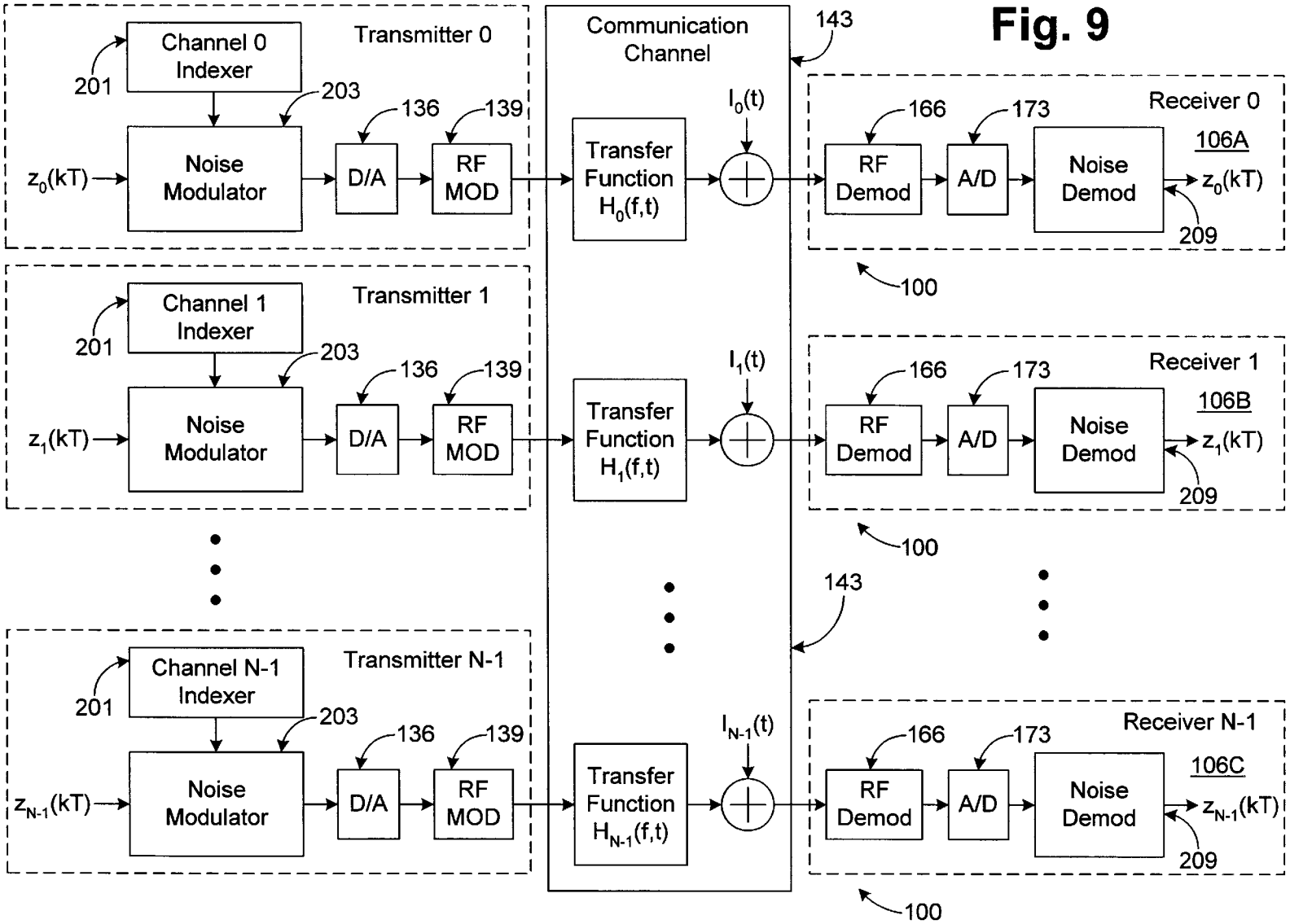
Fig. 9
Transmitter 0
Channel 0 Indexer
201
Noise Modulator
203
D/A
136
RF MOD
139
$z_0(kT)$
Transmitter 1
Channel 1 Indexer
201
Noise Modulator
203
D/A
136
RF MOD
139
$z_1(kT)$
Transmitter N-1
Channel N-1 Indexer
201
Noise Modulator
203
D/A
136
RF MOD
139
$z_{N-1}(kT)$
Communication Channel
143
Transfer Function $H_0(f,t)$
Transfer Function $H_1(f,t)$
Transfer Function $H_{N-1}(f,t)$
$I_0(t)$
$I_1(t)$
$I_{N-1}(t)$
Receiver 0
106A
RF Demod
166
A/D
173
Noise Demod
$z_0(kT)$
209
100
Receiver 1
106B
RF Demod
166
A/D
173
Noise Demod
$z_1(kT)$
209
100
Receiver N-1
106C
RF Demod
166
A/D
173
Noise Demod
$z_{N-1}(kT)$
209
100

SYSTEM AND METHOD FOR COMMUNICATION USING NOISE

CROSS-REFERENCE TO RELATED APPLICATIONS

This application claims priority to copending U.S. provisional patent application entitled "Noise Shift Keying Communication System/Technique for Low Probability of Intercept and Low Bit Error Rate" filed on Dec. 29, 1997 and accorded Serial No. 60/068,890, which is entirely incorporated herein by reference.

TECHNICAL FIELD

The present invention is generally related to the field of communications, and, more particularly, is related to a system and method for noise communication using noise modulation.

BACKGROUND OF THE INVENTION

In many circumstances regarding communications, it is desirable that the information transmitted from one point to the next be kept secret from outside parties. For example, in commercial communications, one may wish to communicate sensitive financial information without one's competitor being able to determine the information sent or to even be aware of the fact that a message was sent. As an alternative example, in military applications, one may wish to communicate without one's enemy being able to intercept and decode the message sent. In pursuit of a communications approach that would meet such demands, noise signaling has been pioneered. The concept of noise signaling has had a history that, much like the broader history of spread spectrum communications of which it is a part, has been superbly documented in, for example, Simon M. K., Omura J. K., Scholtz R. A., and Levitt B. K., *Spread Spectrum Communications,* Vol. 1, Chapter 2, Computer Science Press, 1985.

Much of the earlier efforts in noise communications centered on the problem of generating the "randomness" that would be used to disguise, mask or scramble a transmitted communication signal. This same randomness would have to be faithfully reproduced at the receiving end of the communication link in order to achieve the complementary goal of revealing, unmasking or unscrambling the received signal for the intended listener. Historically, the process of randomization has taken many forms. In addition to the familiar pseudo-random sequences used in Direct Sequence Spread Spectrum (DSSS), frequency hopping, and time hopping, inventors have exploited less familiar techniques aspiring to communication security. There are a number of approaches, for example, that scramble temporal elements of the transmitted communication signal discussed in U.S. Pat. No. 3,824,467 issued to Charles, U.S. Pat. No. 3,978,288 issued to Bruckner, et al., and U.S. Pat. No. 3,921,151 issued to Guanella.

Historically, spread spectrum communications has made use of binary pseudorandom sequences. This initial focus was motivated by the need for simplicity in implementation and control. In those earlier years, the computational power and storage capabilities of small modern computers was unanticipated. The classic example of earlier attempts at noise communication is the famous noise wheel of DeRosa and Rogoff in U.S. Pat. Nos. 2,718,638 and 4,176,316 described at considerable length in Simon M. K., Omura J. K., Scholtz R. A., and Levitt B. K., *Spread Spectrum Communications,* Vol. 1, Chapter 2, Computer Science Press, 1985. As one would expect from a mechanically rotating wheel, this device created a source of cyclically repetitive noise energy. To replicate randomness, Rogoff generated a radial plot of the middle digits of numbers randomly selected from the Manhattan phone directory. Later the plot was transferred to film and, once placed on the wheel, was rotated past a slot of light that intensity-modulated the light in accordance with the length of each radial slot. Information modulation was finally achieved through time-shift keying, i.e., switching between time wheels rotating at slightly different phase offsets. The system accomplished information transfer of approximately one bit per second over a distance of two hundred yards.

Another important contribution is that of Klund in U.S. Pat. No. 5,493,612. This invention uses two techniques to do the information modulation. The first can be thought of as M-ary Frequency Shift Keying (FSK) of the output from a single noise generator. It involves the transmitting of information by essentially changing the carrier frequency in accord with the data symbol by selecting from a very closely spaced set of M frequencies. Filter parameters are chosen so that bandpass filtering of the noise transmission forces the output spectrum to take on the same appearance in each case.

The second technique discussed in U.S. Pat. No. 5,493,612 includes a transmitter which uses a single carrier frequency and selects between noise generators to represent a particular data symbol. This transmitter makes use of analog waveforms which results in spectral splatter due to the discontinuities that occur when the information symbols are imposed on the noise, which this reference fails to discuss.

Another example that makes use of noise is the secret signaling system of Bitzer in U.S. Pat. No. 4,179,658 in which the basic information signal comprises a frequency modulated (FM) voice message. Through a balanced modulator the FM voice input is multiplied by an analog noise signal. Through a separate path the same noise signal is delayed then modulated onto the carrier. The two waveforms, the noise modulated FM voice and the delayed noise waveform (without information superimposed), are then linearly added, thus generating the transmitted signal. With the separate addition of an appropriate delay in the signal path at the receiver, one is able to obtain the reference noise waveform in the received transmission and, thus, demodulate the data. Schemes like this that include the reference noise waveform in the transmission are subject to intercept. In fact, the scheme just described has a very fundamental vulnerability; at just the right delay an interceptor will find that the received signal will correlate very strongly with a delayed version of itself. Additionally, it is not clear to what degree the slower variations of the information signal will affect the measurable statistics of the noise. Clearly, a very slow information signal would introduce a slow, most likely nonstationary, variation into the random noise.

Another secure communication approach is to randomize the transmitted signal by first sending it through a "random" filter. The device described in U.S. Pat. No. 4,393,276 issued to Steele, for example, scrambles the signal in the frequency domain by applying a mask to the Fourier transform of the signal. Because the mask parameters are shared with the receiver, the receiver is able to invert the mask at the other end of the communication link. Also, one signal processing scheme, for example, "randomizes" the power level to simulate fading (U.S. Pat. No. 4,658,436 to Hill) and thus gives the transmission a more natural appearance in the environment.

In contradistinction to the approaches made above, some systems directly radiate noise to mask the existence of an information-bearing signal. Motivated by the fact that directional antennas are subject to enemy sidelobe detection, we find in U.S. Pat. No. 4,397,034 to Cox, et al., for example, an omni antenna used to radiate noise into the sidelobes of a highly directional (one degree beamwidth) antenna. With the noise signal statistically related to the information transmission in order to aid in the masking, the goal of this scheme is to prevent the detection of the information transmission.

Although examples in the journal literature are sparse, the use of noise for communications has not been totally neglected by analysts. Bello, for example, has studied a communication system in which the information-bearing signal phase modulates a noise carrier. Bello, P. A., "Demodulation of a Phase-modulated Noise Carrier," *IRE Transactions on Information Theory,* vol. IT-7, no. 1, pp. 19–27, January 1961. In this reference, the effect of additive Gaussian noise and linear filtering on the first-order statistics of the receiver output noise and some aspects of the output signal are presented along with some simplifications relative to modeling the distortion of the output signal.

Due for the most part to the state of technology of the time, the approaches described above suffer from a number of limitations. Of particular importance is the restrictive limit on availability of noise waveforms at both transmitter and receiver. This is seen, for example, in the noise wheel of Rogoff, et al. in which the "randomness" becomes a fixed part of a wheel that can only hold a small number of random variables because of its finite circumference.

Most of the approaches described in the patent literature that involve the use of true noise are analog in nature. A prototypical example is the multiplication of an information-bearing stream of signals by an analog noise reference carrier. Typically, in such an operation the imposition of information changes the statistical character of the noise. When the information is in the form of a stream of symbols, the transitions between the different symbols appear as discontinuities that give rise to spectral splatter. Such degradation is pervasive. Although one may start with pure wide-sense stationary noise waveforms, the fundamental periodicity of most modern information-bearing communication signals introduces cyclostationary disturbances to the noise. For communication designers interested in covertness, this introduces spectral lines and other features which, unfortunately, waste energy and comprise exactly those features that would be of interest to and could be exploited by an unfriendly interceptor presence.

SUMMARY OF THE INVENTION

The present invention provides a noise communication system which comprises a transmitter and a receiver. Both the transmitter and receiver include, for example, programmable processor based circuits which are programmed to perform noise modulation according to the various embodiments of the present invention, although dedicated logical circuits may be employed as well.

The transmitter includes logic to index through at least two noise records each of which comprise a series of randomly generated samples. Specifically, each of the noise records is divided into noise segments upon which the indexing function is applied. At any given moment, the indexing function identifies a current noise segment for each noise record.

The transmitter also includes logic to modulate a predefined base signal which may be, for example, a voice signal, data signal, or other information source into a noise signal. Each noise record is a source of noise samples for representing a particular symbol of the base signal symbol alphabet. In modulating the predefined base signal, the transmitter replaces the respective symbols of the base signal with the current noise segments from the respective noise records, thereby generating a noise signal in which neither the symbols nor the transmissions between the symbols can be discerned.

The noise signal is transmitted across a communications channel to the receiver which includes logic to demodulate the noise signal into the base signal. The demodulation employs a number of correlators that equals the number of symbols in the base signal and the number of noise records employed at the transmitter. The receiver includes logic to index through the noise records in a similar manner to the indexing performed in the transmitter to produce the same current noise segments for each noise record. Each correlator performs a multiplication function between a current noise segment of samples from the noise record assigned to the correlator and the received segments of samples of the noise signal which reveals a peak output when the segments match. The base signal is recreated by incorporating the symbol corresponding to the noise record that the correlator indicates is the best match to the segment of the received signal.

The present invention can also be viewed as providing a method for modulating a predefined base data signal comprising a stream of symbols from a predefined alphabet of symbols into a noise signal, comprising the steps of: indexing through a plurality of predefined noise segments of at least two noise records, each noise record corresponding to a symbol from the predefined alphabet of symbols; and, modulating the predefined base signal into the noise signal by replacing each the symbols of the predefined base signal with one of the predefined noise segments from the noise record corresponding to each respective symbol.

The present invention may also be viewed as a method for demodulating a predefined noise signal comprising a stream of noise signal segments into a base signal comprising a stream of symbols from a predefined alphabet of symbols, the method comprising the steps of: indexing through a plurality of noise record segments of at least two predefined noise records, each noise record corresponding to symbol from the predefined alphabet of symbols; and demodulating the predefined noise signal by correlating each of the noise signal segments with the indexed noise record segments and determining a maximum correlation value for each of the noise signal segments, the correlation value corresponding to one of the symbols of the predefined alphabet.

The noise communication system and method of the present invention feature significant advantages in that the noise signal generated appears to be actual noise without any periodicities or spectral splatter, making the signal virtually immune to interception and decoding by unauthorized receivers without the noise records employed by the transmitter. Each noise signal can be transmitted in a single frequency band, or multiple noise signals or channels can be transmitted using the same frequency band. In addition, multiple channels may be transmitted using multiple adjacent frequency bands, thus creating an appearance of a spread spectrum signal of even greater bandwidth than the single channel spread spectrum signal. In addition, the base signal may be distributed among multiple channels, thereby increasing the speed of the communication.

The present invention is characterized by, but is not limited to, other advantages such as simplicity of design, user friendliness, robust and reliable operation, efficient operation, and easy implementation for mass commercial production.

Other features and advantages of the present invention will become apparent to one with skill in the art upon examination of the following drawings and detailed description. It is intended that all such additional features and advantages be included herein within the scope of the present invention.

BRIEF DESCRIPTION OF THE SEVERAL VIEWS OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

FIG. 9 is a functional block diagram of multiple noise communication systems of FIG. 1 using the same communications channel;

DETAILED DESCRIPTION OF THE INVENTION

Figure 1:
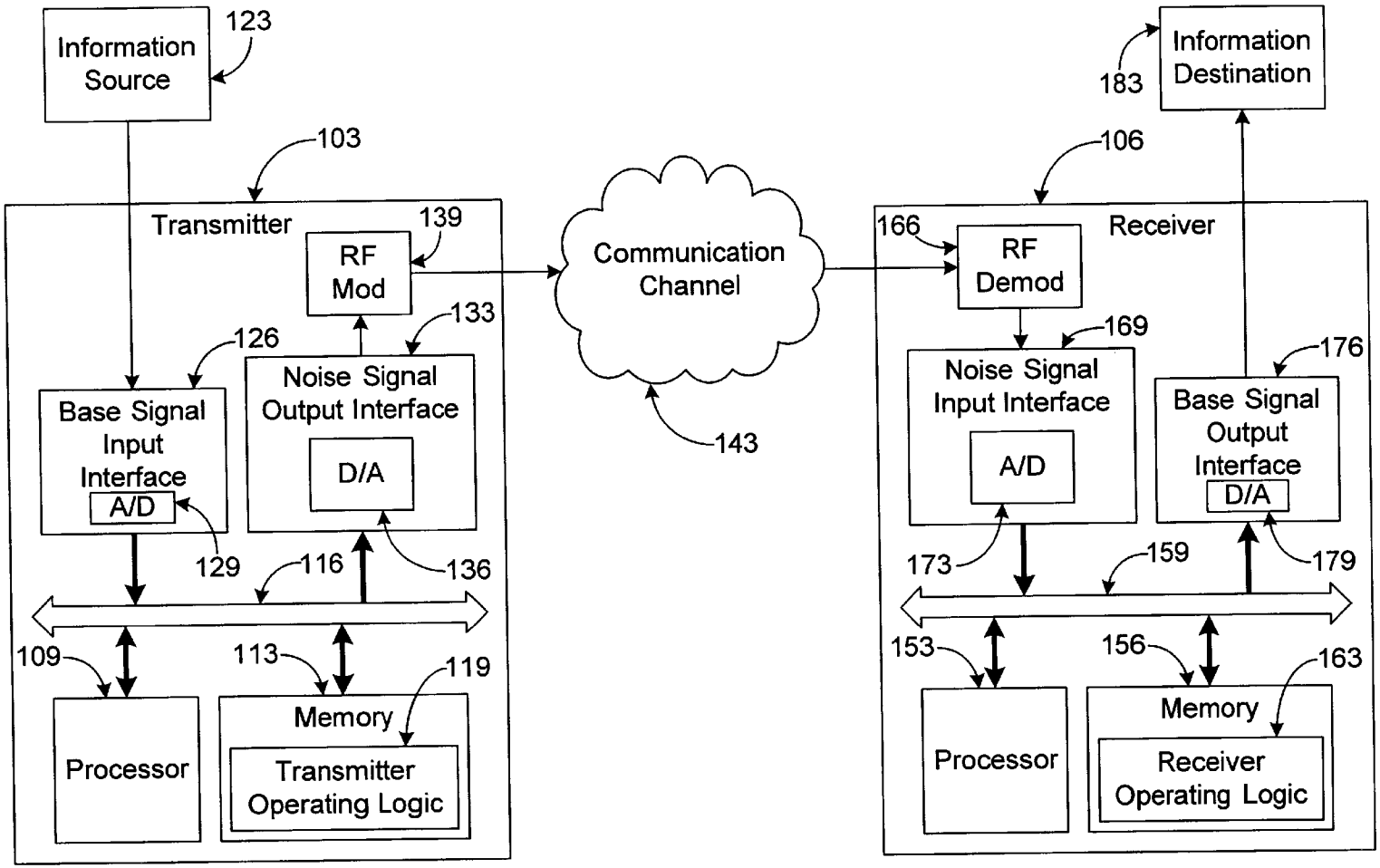
FIG. 1 is a block diagram of a noise communications system according to an embodiment of the present invention.

Turning to FIG. 1, shown is a noise communications system 100 according to an embodiment of the present invention. The noise communications system 100 includes, for example, a transmitter 103 and a receiver 106. The transmitter 103 includes a processor 109 and a memory 113, both of which are coupled to a local interface such as, for example, a data bus 116. Although the memory 113 is shown separate from the processor 109, it is understood that the memory 113 may be part of the processor 109 or may be in two parts, one a part of the processor 109, and a second separate from the processor 109. Stored on the memory 113 is transmitter operating logic 119 which is executed by the processor 109 and controls the general operation of the transmitter 103.

Coupled to the transmitter 103 is a information source 123 which may be a computer, microphone, measuring instrument or other similar source device which generates a base information signal to be communicated to the receiver 106. Note that the base signal may be analog or digital in form, although an analog base signal is assumed herein as an example. The information source 123 is electrically coupled to a base signal input interface 126 which may include, for example, a front end filter as well as an analog-to-digital (A/D) converter 129 when the base signal provided by the information source 123 is an analog signal. The base signal input interface 126 may also include, for example, a buffer and driver circuit to make the digital symbols received from the A/D converter 129 available on the data bus 116.

Note that it may be possible to employ a digital base signal source in place of the information source 123 where the base signal input interface 126 would act as a buffer and interface directly with the data bus 116 writing digital base signal samples directly to the memory 113 to be manipulated by the processor 109. In such a case, the A/D converter 129 is not necessary.

The transmitter 103 further includes a noise signal output interface 133 which may include a buffer to which the processor 109 writes the samples of a digital noise signal which is the base signal modulated in a manner as will be discussed in later text. The noise signal output interface 133 preferably includes a digital-to-analog (D/A) filter 136 which converts the digital noise signal into an analog noise signal. The output of the noise signal output interface 133 is electrically coupled to an input of a radio frequency (RF) modulator circuit 139 which, in turn, is coupled to a communications channel 143.

The receiver 106 also includes a processor 153 and a memory 156, both of which are coupled to a data bus 159. As was the case with the transmitter 103, although the memory 156 is shown separate from the processor 153, it is understood that the memory 156 may be part of the processor 153 or a combination of the two. Stored on the memory 156 is receiver operating logic 163 which is executed by the processor 153. The receiver 106 further includes an RF demodulator circuit 166 with an input coupled to the communications channel 143. The RF demodulator circuit 166 in turn includes an output electrically coupled to a noise signal input interface 169 which preferably includes a front end filter to condition the output of the RF demodulator circuit 166 followed by an A/D converter 173. The noise signal input interface 169 may further include, for example, a buffer and driver circuit to make the digital samples received from the A/D converter 173 available on the data bus 159.

Also coupled to the data bus 159 is a base signal output interface 176 that includes a D/A converter 179 and a buffer circuit. The output of the base signal output interface 176 is in turn electrically coupled to a information destination 183 which may comprise, for example, a device such as a speaker, etc. The information destination 183 may receive a digital signal output which would eliminate the need for the D/A converter 179 such as, for example, when the information destination 183 is a disk drive, etc.

Note that the communications channel 143 may have any number of different physical realizations. For example, the communications channel may be air where the output of the RF modulator circuit 139 is applied to a transmission antenna which radiates the RF modulated noise signal to a receiving antenna coupled to the RF demodulator circuit 166. In a second alternative, the communications channel 143 could be a wire, waveguide or coaxial cable which connects the output of the RF modulator circuit 139 to the input of the RF demodulator circuit 166. In a third alternative the channel could be water with the RF modulator 139 at the transmitting end of the link replaced by an acoustic modulator/hydrophone combination and the RF demodulator 166 at the receiving end of the link replaced by an acoustic hydrophone/demodulator combination. In a fourth alternative the channel may be air with an acoustic radiator at the transmitting end of the link and a microphone pick-up at the receiving end of the link. Deep space or through-the-earth communication is also possible using noise communications as described in this application. In addition, the communications channel 143 may be the current or future telecommunications systems or data communications networks, etc.

Next, a general discussion of the operation of the noise communications system is offered. In the transmitter 103, an analog base signal, such as a voice signal where the information source 123 is a microphone, is generated for transmission to the receiver 106 by the information source 123. The analog base signal is converted into a digital base signal by the A/D converter 129. The digital base signal comprises a series of information symbols selected from an alphabet containing a total of M symbols, where M is generally equal to at least two.

Alternatively, it is also possible that the symbols of the digital base signal be derived from the binary values of a data file stored in the memory 113 or may originate from data generated by a software application executed by the processor 109, rather than ultimately originating from the information source 123 and being applied to the data bus 116 via the base signal input interface 126.

The symbols of the digital base signal are accessed by the transmitter processor 109 via the data bus 116 and samples of a digital noise signal are generated therefrom according to a noise modulation operation of the transmitter operating logic 119 as will be discussed. This digital noise signal is then applied to the noise signal output interface 133 and converted into an analog noise signal by the D/A converter 136. Thereafter, the analog noise signal is RF modulated onto a predetermined carrier for transmission into the communications channel 143 by the RF modulator 139. Alternatively, the samples of the digital noise signal may be stored on a medium such as a hard drive, floppy disk, tape, CD disk, fixed memory, or other similar data storage device for future access. Such storage devices may be portable in nature to allow the digital noise signal samples to be transported to a different location and then accessed.

In the case of transmission across the communications channel 143, at the receiver 106 the RF modulated signal is applied to the RF demodulator 166 where it is demodulated back into the analog noise signal. Then, the analog noise signal is applied to the noise signal input interface 169 in which the analog noise signal is converted to a digital noise signal. The samples of the digital noise signal are accessed by the processor 153 via the data bus 159 which generates the symbols of the digital base signal therefrom pursuant to the receiver operating logic 163, the functionality of which is to be discussed. Note that it is also possible that, the samples of the digital noise signal which are stored on a storage device as discussed alternatively above may be made available to the processor 153 via a disk drive or other device which can access the data stored within the storage devices making the data available on the data bus 159.

The processor 153 applies the symbols of the digital base signal to the base signal output interface 176. The digital base signal is converted into an analog base signal by the D/A converter 179 and is applied to the signal output device such as, for example, a speaker which would recreate the voice signal transmitted, etc. Note that in the case where the digital base signal was derived from a data file, etc., as discussed above, the digital base signal may then be stored on a storage device after the digital base signal is derived from the digital noise signal.

Although the noise communications system using the communications channel 143 described herein shows unidirectional communication from the transmitter 103 to the receiver 106, it is understood that bidirectional communication may be established by combining the physical components and the transmitter and receiver operating logic 119 and 163 into a single unit for all of the various embodiments of the present invention discussed herein. In such a case, a single processor similar to the processors 109 and 153 may be employed with a memory similar to the memories 113 and 156, where the operating logic included both the transmit and receive functionality. The actual functionality of the transmitter and receiver operating logic 119 and 163 is discussed with reference to the various functional block diagrams in the following text.

In addition, the transmitter and receiver operating logic 119 and 163 of the present invention can be implemented in hardware, software, firmware, or a combination thereof In the preferred embodiment(s), the transmitter and receiver operating logic 119 and 163 is implemented in software or firmware that is stored in a memory and that is executed by a suitable instruction execution system. In particular, it is understood that the present invention may be implemented in a dedicated logical circuit comprised of various digital logic components, such components being known to those skilled in the art and not discussed in detail herein.

The transmitter and receiver operating logic 119 and 163, each of which comprises an ordered listing of executable instructions for implementing logical functions, can be separately embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can contain, store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection (electronic) having one or more wires, a portable computer diskette (magnetic), a random access memory (RAM) (magnetic), a read-only memory (ROM) (magnetic), an erasable programmable read-only memory (EPROM or Flash memory) (magnetic), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

Figure 2:
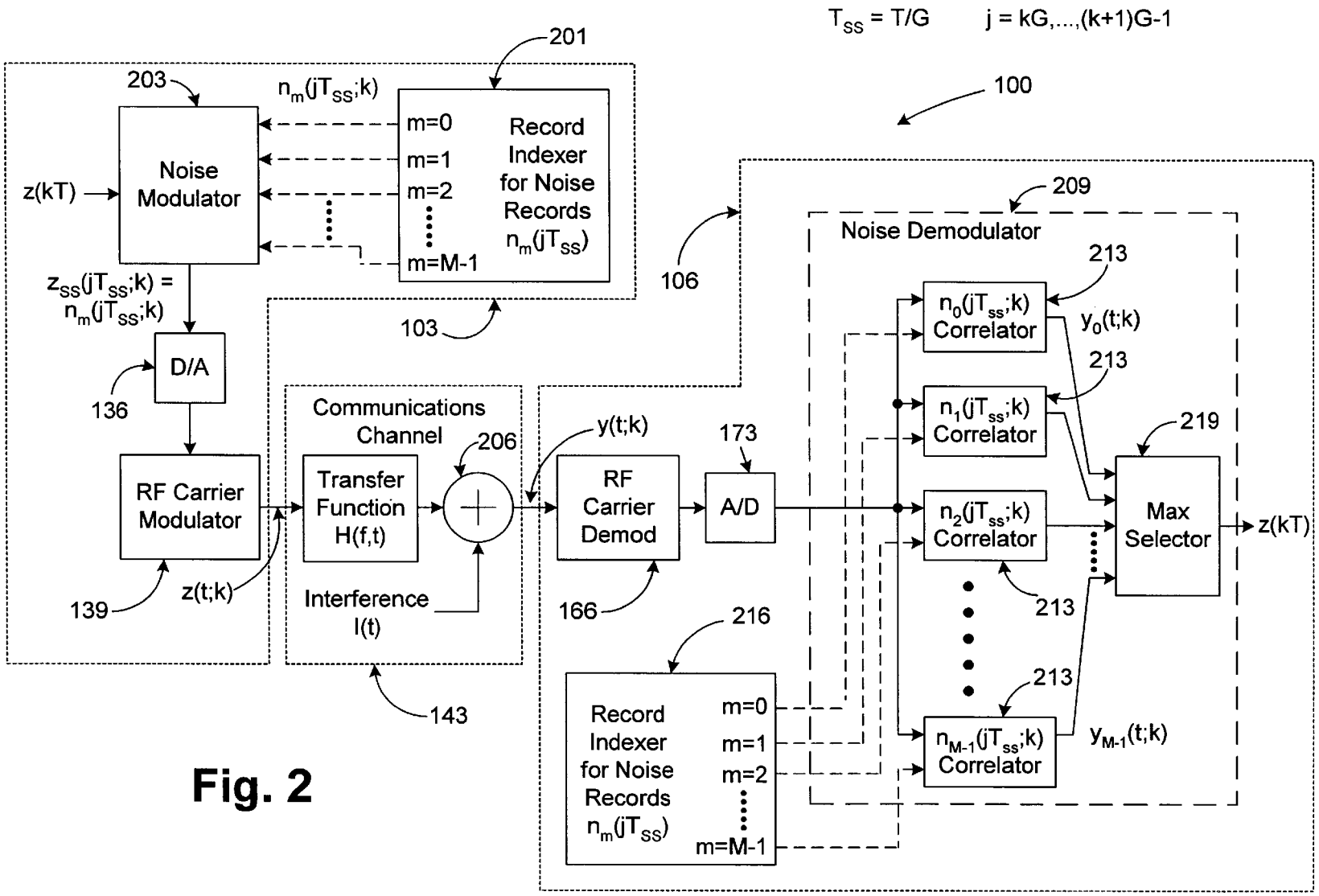
FIG. 2 is a functional block diagram of the noise communications system of FIG. 1.

Referring next to FIG. 2, shown is a functional block diagram of the noise communications system 100 according to an embodiment of the present invention. The functionality of the transmitter 103 includes a record indexer 201 which indexes through the noise segments of a predetermined number of noise records $n_m(jT_{SS})$ that are either generated or accessed from memory, the noise records $n_m(jT_{SS})$ representing the various symbols in the alphabet of M symbols that constitute the digital base signal z(kT). A noise record $n_m(jT_{SS})$ is defined as a predetermined stream of samples that is indexed in time with "j" and clocked out every $T_{SS}$seconds. This stream of samples comprises numerical values that vary in a random, pseudo-random or generally unpredictable manner. Specifically, the $m^{th}$ noise record $n_m(jT_{SS})$ corresponds to the $m^{th}$ symbol in an alphabet of size M in the sense that the $m^{th}$ noise record $n_m(jT_{SS})$ is the noise record $n_m(jT_{SS})$ from which samples are chosen to represent the $m^{th}$ symbol of the alphabet each time that symbol occurs in the digital base signal z(kT). Typically m takes on values between 0 and M−1. For example, in the case of a binary alphabet M=2 and m may take on two values, m=0 and m=1, although it is understood that the alphabet of M symbols may be greater than M=2 for non-binary alphabets.

There are several different approaches by which the random or pseudo-random samples of a noise record $n_m(jT_{SS})$ may be generated, including the use of an algorithmic random number generator, the use of collected samples of random phenomena due to natural or unpredictable causes, or the use of the output of chaotic circuits. The noise records $n_m(jT_{SS})$ may be generated in real time or may simply be stored in memory and accessed appropriately.

Each $m^{th}$ noise record $n_m(jT_{SS})$ comprises a number of segments of noise samples, the $k^{th}$ noise segment of each noise record $n_m(jT_{SS})$ being denoted $n_m(jT_{SS}; k)$. For each noise record $n_m(jT_{SS})$, the $k^{th}$ noise segment $n_m(jT_{SS}; k)$ is used to represent the $k^{th}$ symbol z(kT) of the digital base signal when the $k^{th}$ symbol corresponds with the respective noise record $n_m(jT_{SS})$ according to a predetermined noise segment indexing scheme employed by the noise communications system 100. Each noise segment $n_m(jT_{SS}; k)$ corresponds to a duration of time T equal to the duration of a symbol. The gain G of a particular noise record is defined as the number of samples in each noise segment $n_m(jT_{SS}; k)$, where $T_{SS}=T/G$ and $j=kG, \ldots, (k+1)G-1$. Thus, the number G also corresponds to the number of noise samples that are transmitted for each symbol in the digital base signal. Because noise samples are transmitted G times as frequently as symbols occurring in the base data signal, the signal transmitted over the communication channel has a bandwidth that is G times the bandwidth of the base signal, i.e. the spread spectrum gain factor is G.

The record indexer 201 makes the current noise segment $n_m(jT_{SS}; k)$ from each noise record $n_m(jT_{SS})$ available to a noise modulator 203. Note then, that the record indexer 201 may index through the noise segments $n_m(jT_{SS}; k)$ of each noise record $n_m(jT_{SS})$ by generating the noise segments $n_m(jT_{SS}; k)$ of each noise record $n_m(jT_{SS})$ segment by segment in real time in order to maintain a current noise segment $n_m(jT_{SS}; k)$ for each noise record $n_m(jT_{SS})$ which can then be accessed by the noise modulator 203. Alternatively, if the noise records are stored in memory, the record indexer 201 may index through the stored noise segments $n_m(jT_{SS}; k)$ of each noise record $n_m(jT_{SS})$ by accessing the noise segments $n_m(jT_{SS}; k)$ of each stored noise record $n_m(jT_{SS})$ segment by segment in real time in order to maintain a current noise segment $n_m(jT_{SS}; k)$ for each noise record $n_m(jT_{SS})$ which can, once again, be accessed by the noise modulator 203. Thus, the function of indexing through noise records is defined herein as identifying or maintaining a current noise segment $n_m(jT_{SS}; k)$ for each noise record $n_m(jT_{SS})$, whether the noise records $n_m(jT_{SS})$ are generated or accessed from memory as discussed above. Upon receiving a specific symbol of the digital base signal z(kT), the noise modulator 203 then accesses the current noise segment $n_m(jT_{SS}; k)$ from the noise record $n_m(jT_{SS})$ which represents or is established as the source of samples for representing that particular symbol in noise modulating the digital base signal z(kT).

Thus, each noise record, e.g. the mth noise record $n_m(jT_{SS})$, corresponds to a specific symbol, the $m^{th}$, out of the totality of M symbols that may occur in the digital base signal z(kT). In the standard nomenclature, M is the number of symbols in the alphabet used to represent information in the digital base signal. For example, many modern communication systems use a binary alphabet comprising of a totality of M=2 symbols, namely, "0" and "1". In another example, where a single symbol comprises four binary digits, then the symbol alphabet comprises a total of M=16 symbols to represent the sixteen possible permutations ($2^4$) of symbols, necessitating sixteen corresponding noise records to represent the sixteen symbols.

Given that the record indexer 201 tracks or maintains the current noise segment $n_m(jT_{SS}; k)$ in each noise record $n_m(jT_{SS})$, the noise modulator 203 receives the digital base signal symbol by symbol and, for each symbol, i.e. the kth z(kT), accesses the current noise segment $n_m(jT_{SS}; k)$ from the noise record $n_m(jT_{SS})$ which corresponds to the current symbol of the digital base signal received by the noise modulator 203. In other words, the noise modulator 203 replaces the current symbol of the digital base signal with the proper current noise segment $n_m(jT_{SS}; k)$, thereby generating the digital noise signal $z_{SS}(jT_{SS}; k)$ which, during the occurrence of the $k^{th}$ symbol, is actually equal to the current noise segment $n_m(jT_{SS}; k)$ which was imported to represent the particular symbol of the digital base signal z(kT). Thus, the digital noise signal $z_{SS}(jT_{SS}; k)$ actually comprises a number of noise segments $n_m(jT_{SS}; k)$ which were incorporated to represent the symbols of the digital base signal z(kT). The precise symbol that each of the noise segments $n_m(jT_{SS}; k)$ represents depends upon the noise record $n_m(jT_{SS})$ from which the respective noise segments $n_m(jT_{SS}; k)$ where imported.

The digital noise signal $z_{SS}(jT_{SS}; k)$ that contains the noise samples representing the kth symbol in the symbol stream that constitutes the digital base signal, is then provided to the D/A converter 136 which generates an analog noise signal representing the $k^{th}$ symbol of the digital base signal. This analog noise signal, of approximate duration T, is preceded and followed by analog noise signals of the same duration representing the preceding and following symbols in the input data stream of the digital base signal. This total analog noise signal, continuing for the duration of the communication transmission and representing as many information symbols as required to transmit the source information from the information source 123 (FIG. 1), is applied to the RF carrier modulator 139 which modulates the analog noise signal onto a carrier frequency and transmits it over the communication channel. This total continuous analog noise signal, comprising the individual analog noise signal components z(t,k) corresponding to each symbol, is transmitted to the receiver 106 via the communications channel 143. The communications channel 143 tends to degrade the transmitted signal and is here represented by a time-varying transfer function H(f,t) and an adder 206 which adds an interference signal I(t) to the transmitted noise signal. The communications channel 143 thus modifies each transmitted analog noise signal component z(t;k) into a received analog noise signal component y(t;k) which is applied to an RF carrier demodulator 166 which demodulates the received noise signal component y(t;k) down from radio frequency into a baseband analog noise signal. This analog noise signal is then applied to an A/D converter 173, resulting in a digital noise signal which is then applied to a noise demodulator 209.

Note in the alternative that the digital noise signal $z_{SS}(jT_{SS}; k)$ may also be stored on a storage device such as hard drive or floppy disk, etc., which may then be transmitted via the communications channel 143 at a later time, or physically carried to the receiver 106 and accessed at a later time as discussed previously.

The noise demodulator 209 includes a predetermined number of correlators 213 that generally equals the number M of noise records $n_m(jT_{SS})$ used in the noise modulator 203. Each correlator 213 performs a correlation function associated with a specific noise record $n_m(jT_{SS})$ stored at or otherwise available at the receiver 106, e.g. the mth noise record $n_m(jT_{SS})$. The receiver 106 includes a record indexer 216 which is similar to the record indexer 201 of the transmitter 103. The record indexer 216 indexes through the noise segments of each noise record $n_m(jT_{SS})$ in order to provide or make available a current noise segment $n_m(jT_{SS}; k)$ to each of the correlators 213 in order that each correlator may perform the correlation function.

Recall that the received digital noise signal that is provided to the noise demodulator 209 is comprised of the noise segments that resulted from the noise modulation process in the transmitter. Each segment of the received digital noise signal is fed into every correlator 213 where it is correlated with the current noise segment $n_m(jT_{SS}; k)$ from the record indexer 216 from the noise record assigned to the respective correlator 213. The correlation function, which is described later, reveals whether a received noise segment matches a current noise segment $n_m(jT_{SS}; k)$ in the correlator 213 at any given time. Thus, only one of the correlators 213 will have a match for each noise segment of the digital noise signal since only one of the noise records was used to represent the particular symbol of the digital base signal z(kT). Each correlator generates a peak output when a match is experienced.

The output of each correlator 213 is applied to a maximum selector 219 which determines which of the output signals received from the correlators 213 is greatest for each segment of the digital noise signal. Upon determining which correlator 213 has experienced a match as indicated by a peak output, the maximum selector 219 will output the symbol associated with the noise record assigned to the particular correlator 213 experiencing the match, thus recreating the base signal z(kT). Note that although each single correlator 213 is shown to correlate a single noise record with a received noise segment, it would be possible that a single correlator 213 correlate several noise records with each noise segment provided processor speeds are adequate to handle the number of calculations within the necessary time increments.

Figure 3:
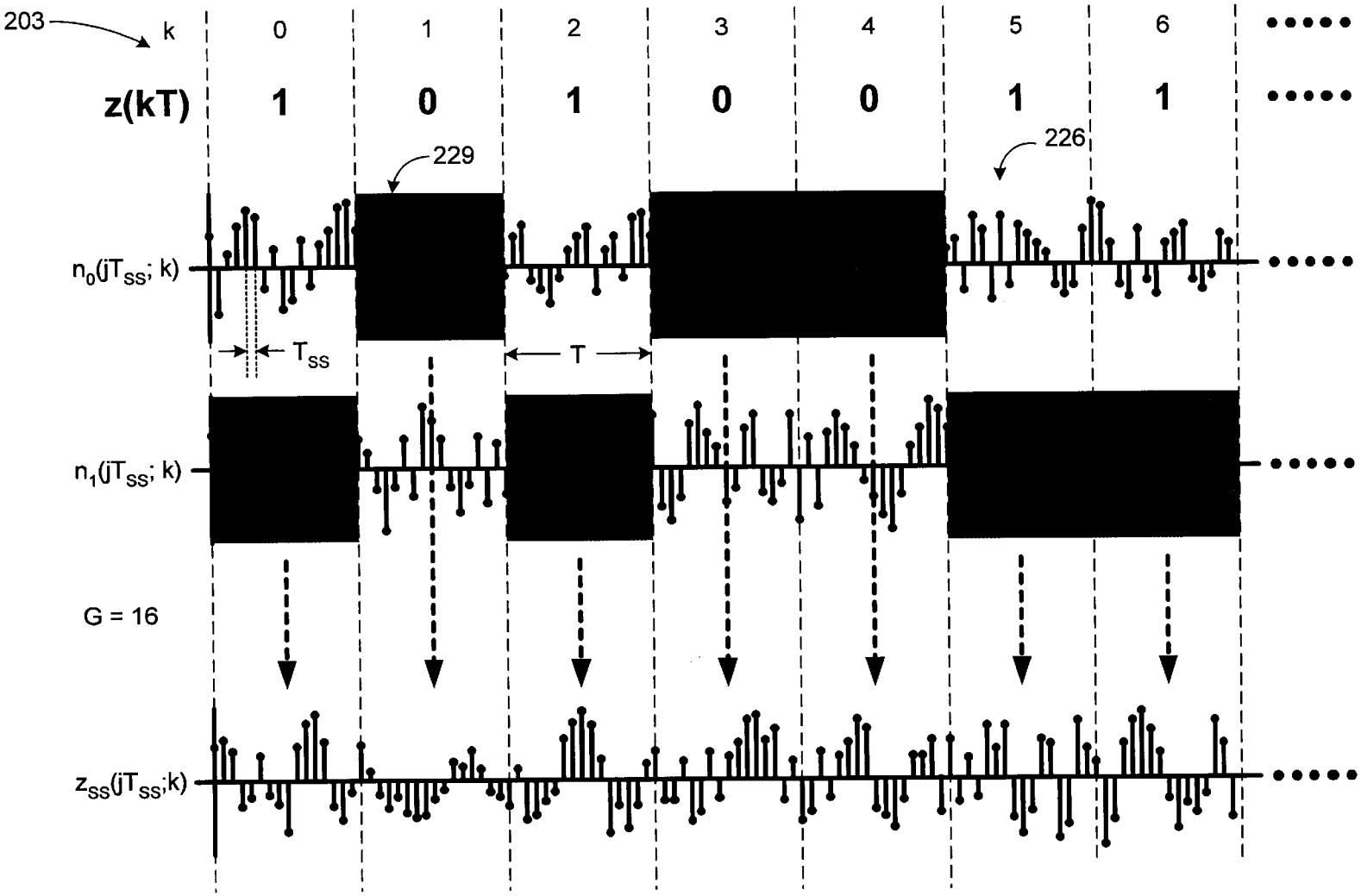
FIG. 3 is a drawing illustrating an example of the noise modulation employed in the noise communication system of FIG. 1.

Turning next to FIG. 3, shown is a drawing illustrating the functionality of the noise modulator 203. For a specific symbol period k which is equal to time T in length, there is a corresponding symbol of the base signal z(kT) equal to, for example, either "0" or "1". Thus, this example noise modulator assumes an alphabet size of M=2 (binary data communications) to simplify the following explanation.

In addition, shown are a first noise record $n_0(jT_{SS}; k)$ that is assigned to the symbol "0" and a second noise record $n_1(jT_{SS}; k)$ which is assigned to the symbol "1". The first and second noise records $n_0(jT_{SS}; k)$ and $n_1(jT_{SS}; k)$ include randomly generated samples which are separated by time $T_{SS}$. The first and second noise records $n_0(jT_{SS}; k)$ and $n_1(jT_{SS}; k)$ are divided into noise segments 226 which coincide with each symbol period $T=GT_{SS}$with a unique noise segment 226 being associated with each symbol of the digital base signal z(kT). Note that for each symbol period T, the first and second noise records $n_0(jT_{SS}; k)$ and $n_1(jT_{SS}; k)$ each have 16 samples which translates into a gain G of 16 for each noise record. At the bottom is shown the digital noise signal $z_{SS}(jT_{SS}; k)$.

In generating the digital noise signal $z_{SS}OT_{SS}; k)$ for each symbol of the digital base signal z(kT), the indexer 201 (FIG. 2) identifies a current noise segment 226 that may represent the symbol for both the first and second noise records $n_0(jT_{SS}; k)$ and $n_1(jT_{SS}; k)$. The actual value of the digital base signal (either "0" or "1") will determine whether the noise segment 226 from the first noise record $n_0(jT_{SS}; k)$ or the second noise record $n_1(jT_{SS}; k)$ is used to generate the corresponding segment of the digital noise signal $z_{SS}(jT_{SS}; k)$. Note that for k=0, the digital base signal z(kT) is equal to 1. In such a case, the noise modulator 203 (FIG. 2) incorporates the noise segment 226 from the second noise record $n_1(jT_{SS}; k)$ which is indicated by the shaded region 229. Thus, the noise segments 226 of the digital noise signal $z_{SS}(jT_{SS}; k)$ are equal to those noise segments 226 of the first and second noise records $n_0(jT_{SS}; k)$ and $n_1(jT_{SS}; k)$ which are indicated by the shaded regions 229.

Figure 4:
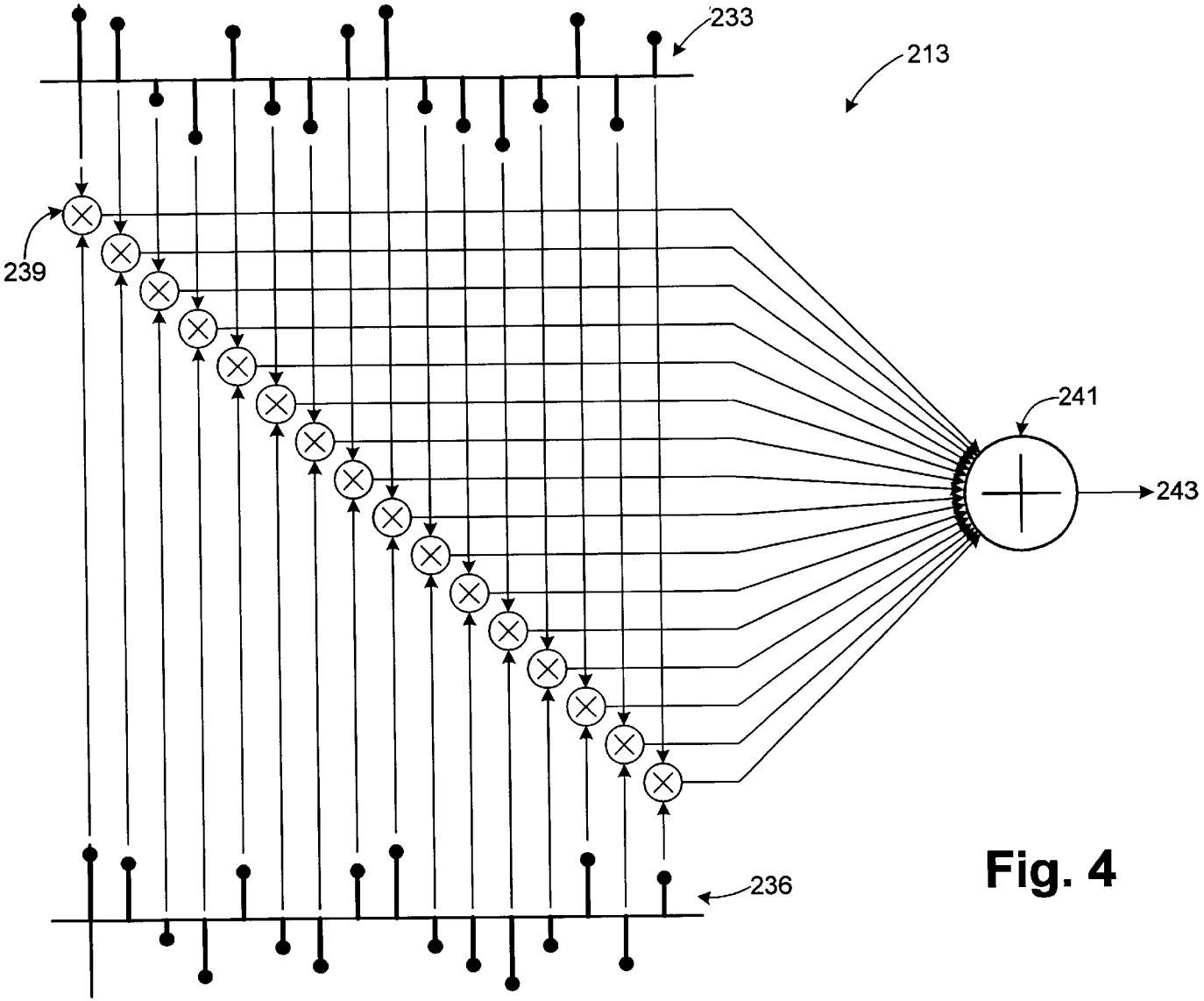
FIG. 4 is a drawing illustrating an example of the correlation employed in the noise communications system of FIG. 1.

Referring next to FIG. 4, shown is a block diagram of the correlation function performed by the correlators 213 (FIG. 2). In performing the correlation function, the current noise segment 233 from a respective noise record $n_m(jT_{SS})$, stored or otherwise available at the receiver, is multiplied sample for sample by the current received noise segment 236 of the received digital noise signal transmitted by the transmitter 103 (FIG. 2) as indicated by the multipliers 239. Generally, this current received noise segment is a distorted version of the corresponding segment of the digital noise signal $z_{SS}(jT_{SS}; k)$ transmitted by the transmitter 103 (FIG. 2) due to distortion originating in the communication channel 143 (FIG. 1).

The results from each of the multipliers are applied to an adder 241 which sums the results of each multiplication and generates a resulting correlator output 243. When the current noise segment 233 is approximately equal to or similar to the current received noise segment 236, correlator output 243 is a peak value. This is the case as shown in FIG. 4 as the current noise segment 233 and the current received noise segment 236 match. This is due to the constructive multiplication of corresponding equal samples, even if the current received noise segment 236 has been distorted or otherwise altered due to interference, etc. If the current noise segment 233 is not equal to the current received noise segment 236, then the correlator output 243 is generally a low value due to the canceling effect of multiplication of random samples.

Note that the peak value that occurs when a match is experienced between the current noise segment 233 and the current received noise segment 236 may be increased or decreased by adjusting the gain G which is the number of samples in the noise segments. Thus, the present invention provides a distinct advantage in that the gain G can be adjusted in light of interference, etc. Note that it may be possible that the gain G be dynamically adjusted higher or lower during the occurrence of noise communications discussed herein in reaction to varying degrees of interference experienced during the noise communication by use of a control channel between the transmitter 103 (FIG. 1) and the receiver 106 (FIG. 1) or by other means of sensing the amount of degradation due to interference in the communication channel 143 (FIG. 2).

Turning back to FIG. 2, in order to ensure that the current received noise segments 236 will closely resemble the current noise segment 233 on a sample for sample basis, the A/D converter 173 samples the analog noise signal at the proper discrete times which should substantially coincide with the times at which the actual samples of the digital noise signal were generated in the transmitter 103. This may be accomplished by undergoing a training process in the receiver 106 known by those skilled in the art using, for example, a predetermined noise sequence or other means of symbol synchronization.

Figure 5:
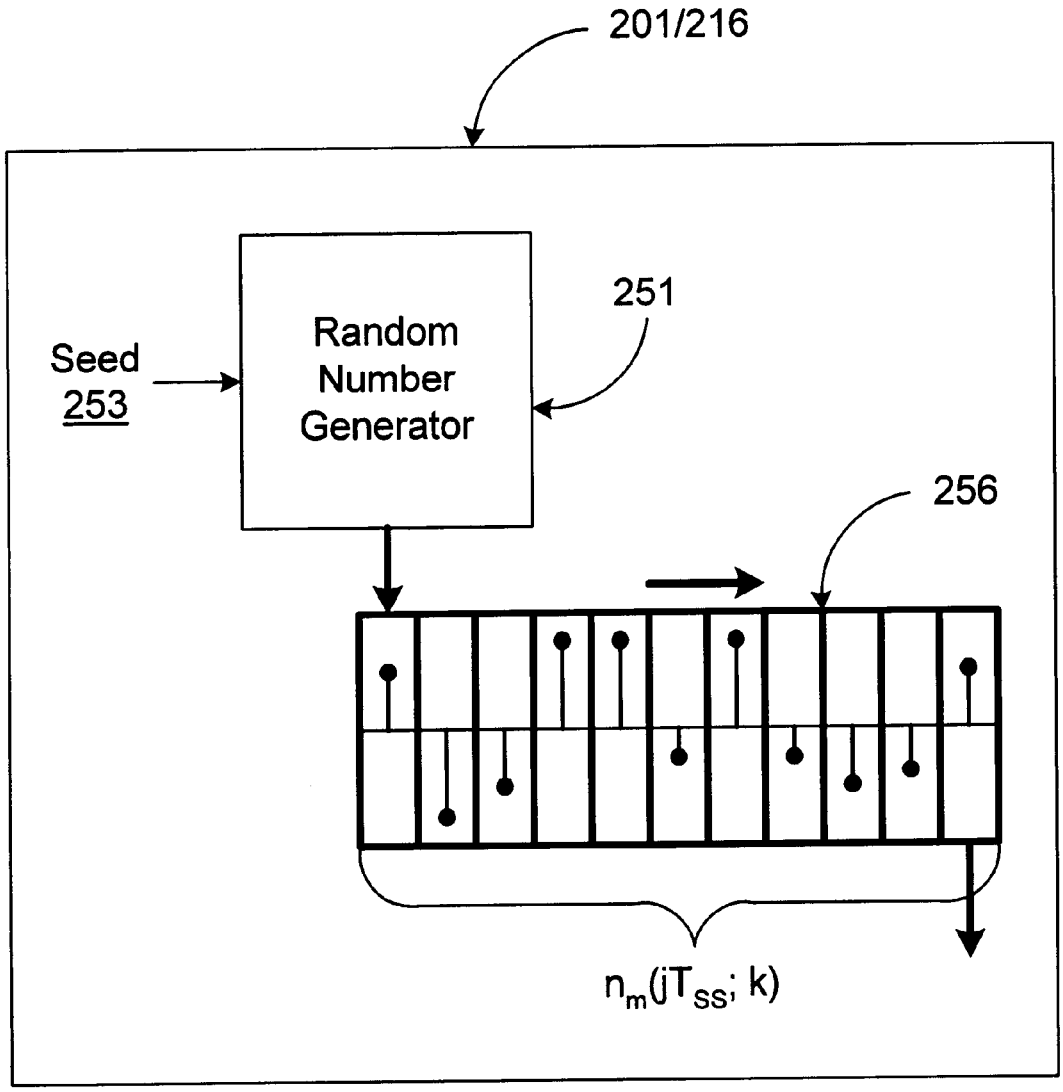
FIG. 5 is a block diagram showing a random number generator that may be employed to generate a noise record used in the noise communications system of FIG. 2.

Referring then to FIG. 5, shown is an example of the noise record indexers 201/216 which employ, for example, a random number generator 251 to generate one or more noise records $n_m(jT_{SS})$ (FIG. 2). As mentioned previously, the noise records $n_m(jT_{SS})$ might be stored in memory 113/156 (FIG. 1) and accessed as needed. However, this may necessitate significant storage space in the memory 113/156. Thus, a different approach is to use a random number generator 251 which includes an input to receive a seed 253 from which a string of random numbers or samples are generated. The precise operation of a random number generator 251 is known by those skilled in the art and not discussed in detail herein. The random number generator 251 outputs samples of a noise record into, for example, a shift register 256. The shift register 256 maintains a single noise segment $n_m(jT_{SS}; k)$ of a noise record to be accessed by the noise modulator 203 (FIG. 2) or the noise demodulator 209 (FIG. 2). Note that the random number generator 251 may generate several noise records $n_m(jT_{SS})$, depending upon the number of noise records employed by the noise modulator/demodulator 203/209. The shift register 256 provides a distinct advantage in that only a single noise segment $n_m(jT_{SS}; k)$ need be maintained at a given time which saves space in memory 113/156 (FIG. 1). Note that the noise records generated at the locations of both the transmitter 103 and the receiver 106 are identical. This may be accomplished, for example, by employing identical random number generators 251 with a common seed 253 in the record indexers 201/216 at the transmitter 103 and the receiver 106. As known in the art, identical random number generators 251 initialized at the same time with the same seed 253 will generate identical random number sequences at the same time. In order to refresh or renew the noise samples and prevent a third party from determining them, the random number generators 251 in the indexers 201/216 of the transmitter 103 and the receiver 106 could be reinitialized with new seeds 253 at mutually agreed upon instants of time. An alternative possibility is that the actual seeds 253 used and/or the time instants of change could be determined or selected algorithmically according to the values of certain unpredictable numbers occurring in nature or in the affairs of society and business (e.g. from stock market indices). In addition, the seeds 253 could be altered dynamically during the occurrence of noise communications using a separate control channel.

Further, for example, a variety of changes to both the noise records and the ways they are processed can be done dynamically while the noise communications system 100 is working, and do not require an interruption of service. In many cases the goal of such dynamic changes would be to adapt to changing channel conditions or, in the case of several of the examples possibilities for dynamic change can't be listed, some possibilities for dynamic change beyond those described earlier include the following: changing the value of the gain G in order to guarantee reliable communication in a changing communication environment indicated by time changes in the communications channel 143 (FIG. 2); changing the noise records whether it be the nature in which they are generated or changing the particular method of partitioning a source record as previously discussed for privacy purposes; changing the symbol rate (or equivalently the symbol duration T) in z(kT) appearing at the input of noise modulator 203 (FIG. 2), changing the clock rate of the D/A converter 136 (FIG. 2) and the A/D converter 173 (FIG. 2) in order to change the bandwidth of the propagating communication signal.

All dynamic changes and events can be made to take place at precisely clocked, prearranged times, or can be simultaneously timed and triggered at both the transmitter 103 and receiver 106 using separate control channels, or can be triggered by external events that are observable at the transmitter and receiver locations.

A distinct advantage of the noise communications techniques described in this application is that noise communication systems can be built such that all the operating parameter changes described above (with the possible exception of changing D/A and A/D clock rates) can be accomplished without hardware changes.

Figure 6:
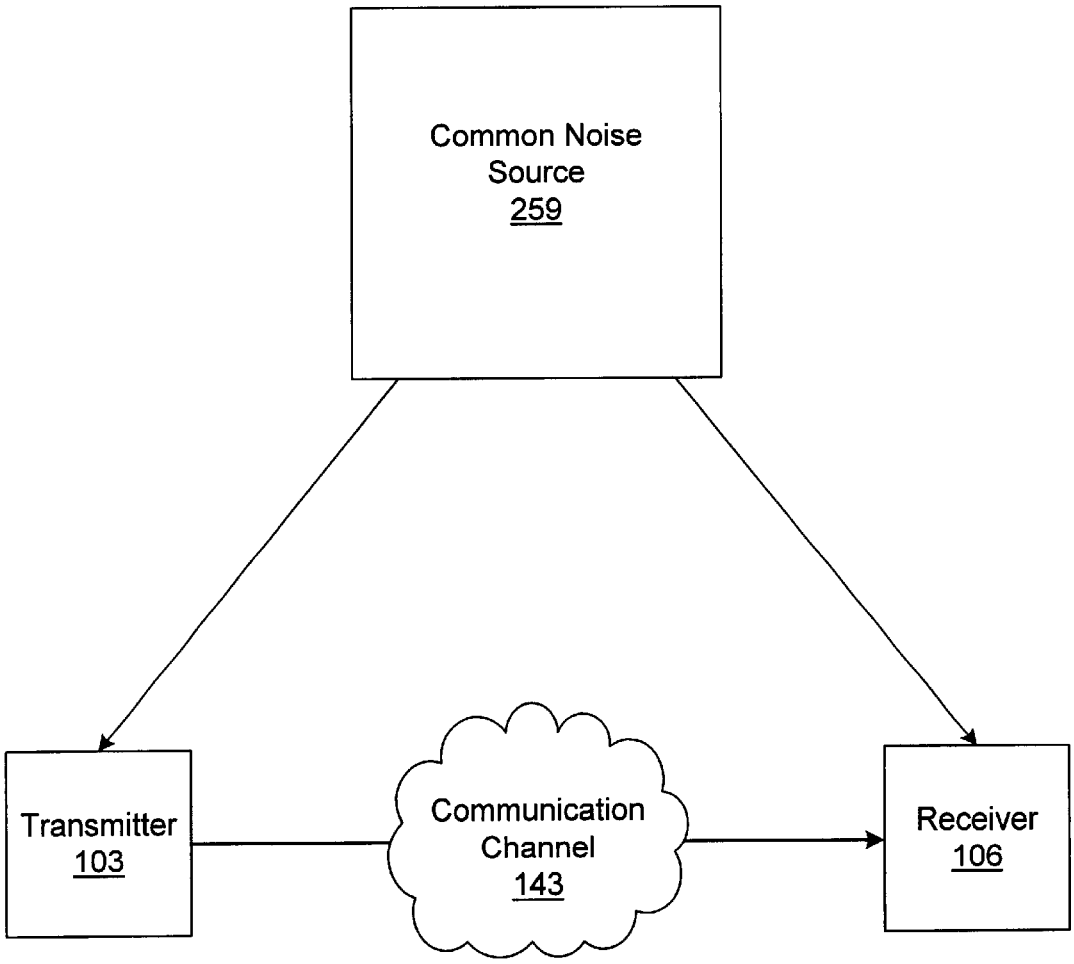
FIG. 6 is a block diagram showing a common noise record source accessible by the transmitter and the receiver of the noise communications system of FIG. 2.

Turning to FIG. 6, another method of creating the random noise samples of a noise record $n_m(jT_{SS})$ (FIG. 2) is to measure and store samples at both the transmitter 103 and the receiver 106 of observable natural data or phenomena from a common noise source 259 arising from the activities of human beings or their machines. If the same data or phenomena are not directly observable by both the transmitter 103 and receiver 106, a noise record $n_m(T_{SS})$, to be shared by both the transmitter 103 and receiver 106 at the ends of a communication link, could be physically distributed or transported from one end of the link to the other, or transmitted over a dedicated communication link.

A simple, but important way to double the number of noise records $n_m(jT_{SS})$ that have been generated by random number generators 251 or other random or pseudo-random means is to multiply each sample by −1, which inverts the noise record $n_m(jT_{SS})$ in question. This is a preferred approach in binary communications for generating two noise records $n_m(jT_{SS})$ from a single noise record.

Figure 7:
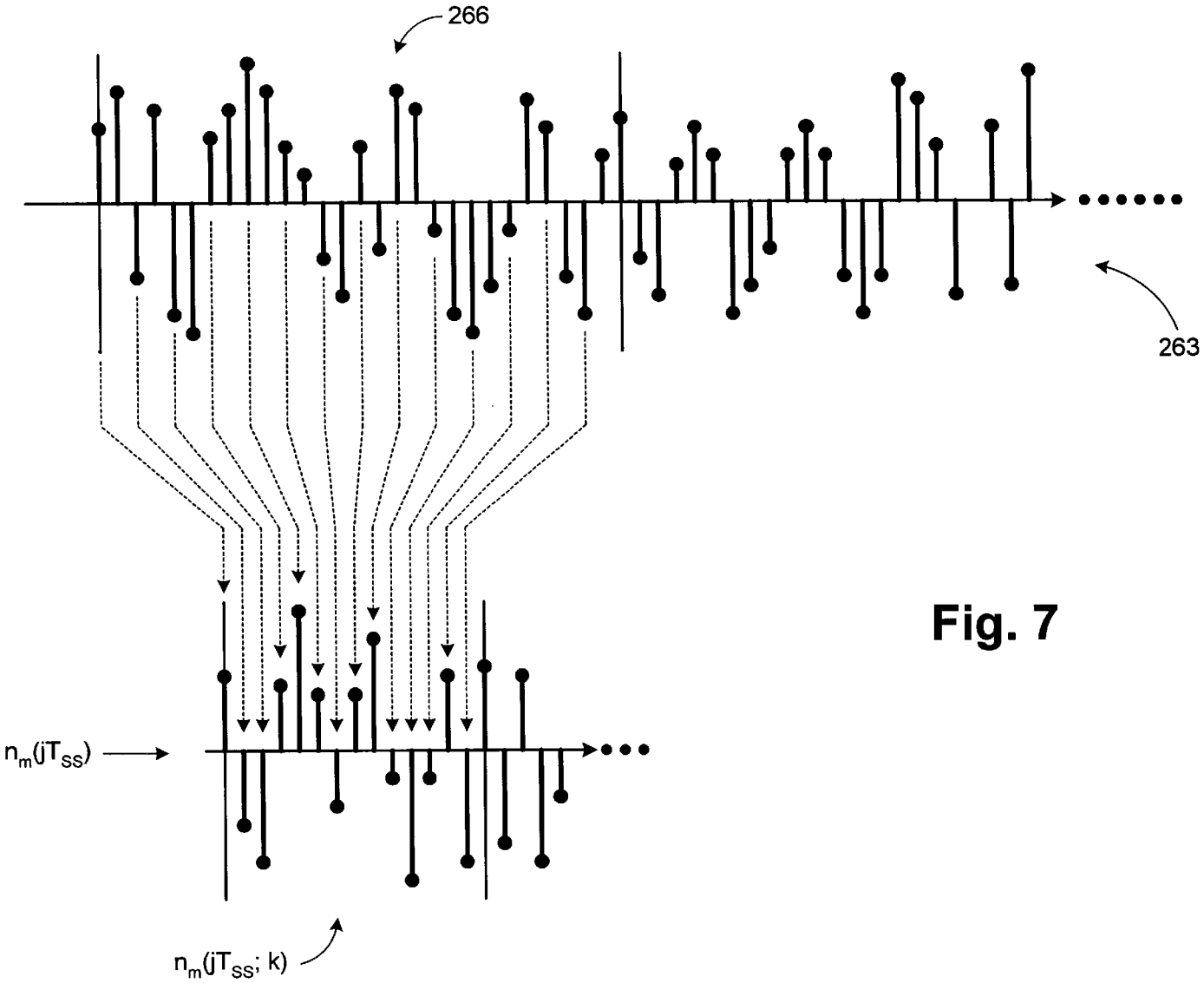
FIG. 7 is a drawing of a source record which may be employed to generate the noise records used in the noise communications system of FIG. 2.

With reference to FIG. 7, shown is another approach which may be employed to generate the noise records $n_m(jT_{SS})$ using what is referred to herein as a source record 263. A source record 263 is defined herein as a stream of samples from which multiple noise records $n_m(jT_{SS})$ are obtained. The source record 263 may be stored in the memory 113/156 of the transmitter/receiver 103/106 and accessed as will be described. The source record 263 may also be generated using a random number generator 251 (FIG. 5) similar to the manner in which a noise record $n_m(jT_{SS})$ may be generated as described previously. The source record 263 is advantageously split into source record segments 266 as shown. Each source record segment 266 may comprise either more or less samples than do the noise record segments $n_m(jT_{SS}; k)$, depending upon the particular application. Thus, the samples of the source record 263 are generated at an appropriate sample rate depending upon the size of the source record segments 266.

The function of deriving the predetermined number M of noise records $n_m(jT_{SS})$ from a source record 263 is defined herein as "partitioning" a source record 263. A source record 263 may be partitioned in many different ways, a few of which are described herein as examples. As seen in FIG. 7, for example, a noise record segment $n_m(jT_{SS}; k)$ may be generated from a source record segment 266 by using every $N^{th}$ sample of the source record segment 266. The example of FIG. 7 shows that every $2^{nd}$ sample of the source record segment 266 is used to create a noise record segment $n_m(jT_{SS}; k)$, although it is understood that virtually any interval may be used. Note in the example shown in FIG. 7, the number of samples in the source record segment 266 is double the number of samples in the noise record segment $n_m(jT_{SS}; k)$.

In another partitioning approach, the source record segments 266 may be split up according in a predetermined fractional manner. For example, for the predetermined number M of noise records $n_m(jT_{SS})$, the source record segments 266 may be divided in time into M segments, each one used as a particular noise record segment $n_m(jT_{SS}; k)$.

In yet another partitioning approach, the samples of each $m^{th}$ noise record $n_m(jT_{SS})$ may be chosen according to a corresponding $m^{th}$ random selection order. A random selection order entails a random sequence of sample positions in a particular source record segment. Each $m^{th}$ random selection order may be predetermined and stored in memory 113/156 (FIG. 1) or generated using a random number generator 251 (FIG. 5). Note that if a random generator 251 is used, common seeds may be employed and altered dynamically during the occurrence of noise communications using a unique communications channel as will be discussed. Alternatively, each mth random selection order may be generated using an unseeded random number generator and each new random selection order may be communicated from a transmitter 103 to a receiver 106.

In still another approach, the samples of the noise record segments $n_m(jT_{SS}; k)$ may be calculated from the samples of the source record segments 266 according to a number of M randomized series of equations, each series providing a corresponding $m^{th}$ result for each sample of the source record segment 266 which is plugged into the equations. Note that the calculated approach may employ any order of samples of the source record segment 266 as described above.

Finally, an additional approach involves simply scrambling the source record segments 266 into unique noise record segments $n_m(jT_{SS}; k)$. In this manner, a number M of unique noise record segments $n_m(jT_{SS}; k)$ may be generated from a single source record limited by the actual number of permutations of noise record segments $n_m(jT_{SS}; k)$ obtainable based on the number of samples employed in each source record segment 266.

The methods described above for partitioning one noise record into a multiplicity M of noise records are just a few of many techniques for accomplishing the same goal. A secondary goal of minimizing the amount of memory space necessary for storage may be accomplished, depending on the approach is employed. Naturally, any partitioning method, generally establishes identical partitions at both the transmitter 103 and receiver 106.

Figure 8:
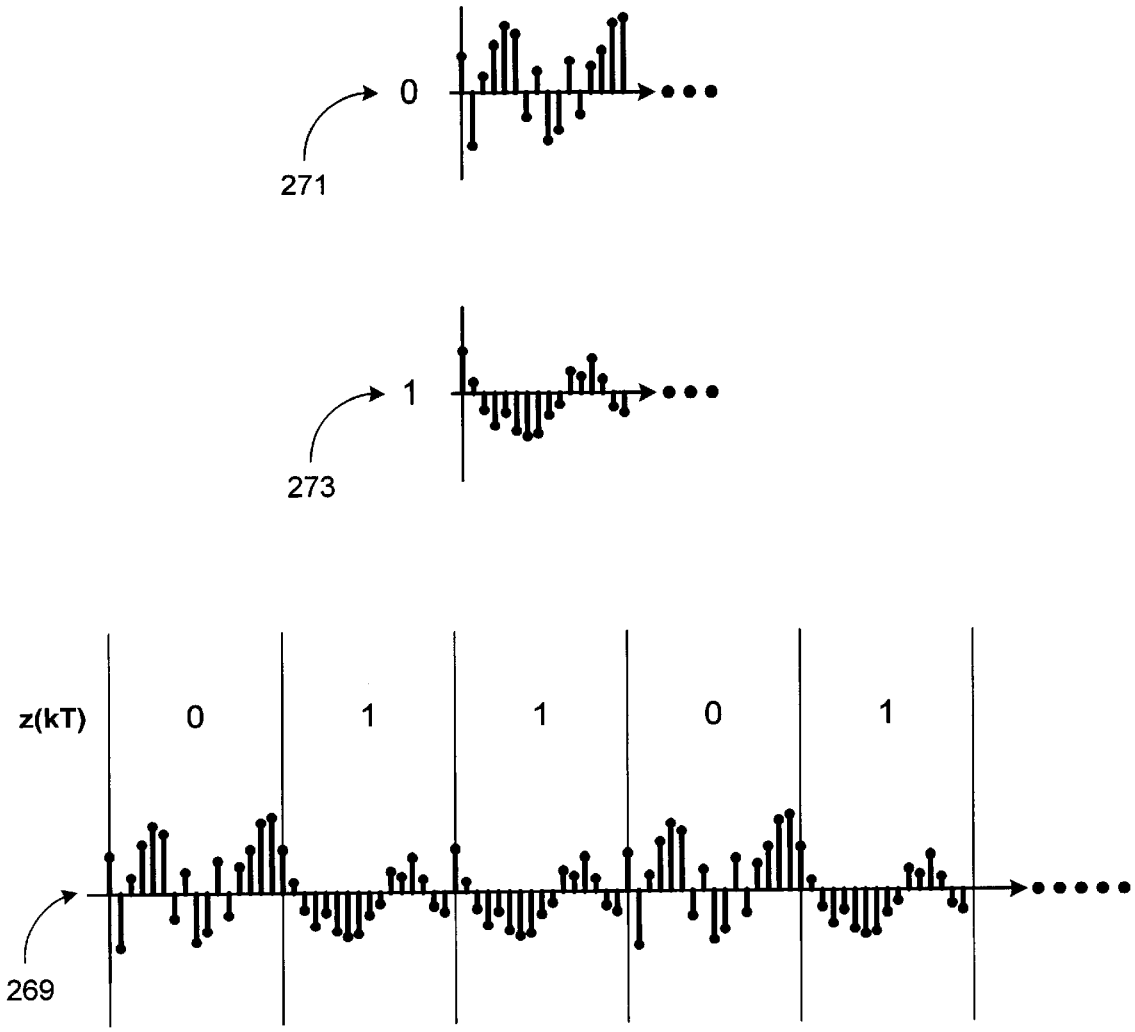
FIG. 8 is a drawing of a noise signal generated by the noise communications system of FIG. 2 using repeated noise segments to represent the symbols of the base signal.

Turning to FIG. 8, shown is a noise signal 269 in which each symbol is represented by a single noise segment which is repeated upon every occurrence of that particular symbol in the base signal z(kT). FIG. 8 shows an example where the alphabet of symbols is equal to 2 (M=2), namely, "0" and "1". A first noise segment 271 represents the first symbol "0" and a second noise segment 273 represents the second symbol "1". Once again, the binary case is shown as an example for illustration purposes, but it is understood that an alphabet may have any number M of symbols, each represented by a unique noise segment 271, 273, etc.

Although the use of essentially unlimited streams of non-repeating noise samples to generate noise records provides certain advantages in performance and allows for a simpler explanation of the operation of a noise communications system and its benefits, the noise signal 269 illustrates that this is not always necessary. If the builder or user of a noise communications system is willing to forego certain benefits in performance, a noise communication system 100 (FIG. 1) can be operated with repeating noise segments such as, for example, the first and second noise segments 271 and 273. The case illustrated in FIG. 8, as well as other implementations that don't repeat samples as frequently, is subject to some performance limitations. Primary among these is that privacy or secrecy is sacrificed because the determination of noise samples (and hence the communication message) by an unfriendly presence is enabled by detection/processing schemes that make use of the repeating noise samples. A secondary performance limitation due to the use of repeated noise samples would be that the communication signal transmitted into the communication channel 143 (FIG. 1) would be nonstationary. Because of the periodicities due to the repeated nature of the signal, the communication transmission would not, in general, have a time constant power spectrum and would contain spectral lines. Such time variations and spectral lines represent signal energy that is not related to information content, hence representing a reduction in communication efficiency. Thus, true noise signals without such periodicities and spectral lines feature greater efficiency than conventional information signals. Additionally, in a multi-user environment such features make the communication waveform, as an actual or potential interferer of other operating communication systems (perhaps occupying the same spectral space), more difficult to analyze and control.

In describing "noise communications" the word "noise" is used and the properties of pure noise are assumed for at least two major reasons. First, systems that actually use noise are the easiest to understand. Second, when specific actual noise properties are assumed for the "noise", the problem of determining the performance of a noise communications system is analytically tractable and can be analyzed mathematically. Nevertheless, it is possible to conceive of a variety of noise communications systems that do not use pure noise. It is understood that the methods and structures of noise communication systems described above can be built and operated using "noise" that has less than ideal properties.

Despite the fact that noise communications can be implemented with a wide variety of sample sets that do not possess what practitioners of the art would identify as the usual properties of noise, there are a number of factors that motivate the use of true noise samples. First, with true noise samples the samples do not occur in any predictable or cyclical fashion and hence enable a guarantee of message privacy. Second, the use of true noise samples guarantees (to an extent depending on G, the number of noise samples transmitted per data symbol) that the set of samples used to represent one data symbol will not correlate with the set of noise samples used to represent another, e.g. that only the correlator 213 (FIG. 2) matched to $n_2(jT_{SS}; k)$ will respond with a substantial output when the receiver 106 (FIG. 2) receives the transmission corresponding to $z_{SS}(jT_{SS}; k)=n_2(jT_{SS}; k)$ at the output of the noise modulator 203 (FIG. 2). Third, the use of noise samples that are independent in the sense that every noise sample is statistically independent of every other noise sample (as is usually the case for the sample outputs of most random number generators) guarantees that the noise samples within one k segment of the transmitted digital communication signal $z_{SS}(jT_{SS}; k)$ (FIG. 3) are related to one another statistically in exactly the same sense that noise samples straddling the boundary between two different k values are related to one another. Specifically, as an example, this means that there is virtually nothing about the noise samples of the transmitted digital communication signal $z_{SS}((jT_{SS}; k)$ (FIG. 3) as it transitions from the segment $z_{SS}(jT_{SS}; 1)$ to the segment $z_{SS}(jT_{SS}; 2)$ to indicate that the data symbol z(kT) has changed from a "0" to a "1". To an outside observer or unfriendly presence who has no knowledge of the noise records used to construct this communication signal, the data symbol transitions are totally invisible.

Turning back to FIG. 2, the noise records $n_m(jT_{SS})$ needed for noise communications can be stored on familiar "hard" media, such as hard disks, floppy diskettes, CD-ROMs, and DVDs (Digital Versatile Disks) and other media, and can be shared via physical distribution of copies of same. To the degree the noise records on these physical media can be kept secret, communications of secret or private messages can be maintained. In addition to physical distribution, total noise records can also be distributed using dedicated communication links to electronically distribute the noise records. It is not necessary to distribute noise records in their entirety. In fact, an approach that places less of a burden on support communications, i.e. separate control links, is the distribution of parameters than can be used to initialize and reset noise generators, e.g. seeds for random number generators. The parameters required for identical shuffling (as described earlier in this application) of old noise records to form new noise records at physically separate transmitter and receiver locations can also be distributed by electronic or physical means. Finally, it is well within the realm of possibility to make use of third party noise sources whereby a communication transmitter and receiver at different locations opt to observe some continually occurring natural or man-made phenomena in order to directly read noise samples to create new noise records or to process the observed phenomena to obtain the parameters required to drive, initialize or reset random number generators.

The noise communications system 100 features several significant advantages. Foremost is the advantage of secrecy in that the noise modulated signal is extremely difficult to decode without knowing the noise records with which to perform the necessary demodulation functions. The signal simply looks like random noise to a would-be interceptor. Further, since the noise segments are true noise in that the samples are random in nature, there are no discontinuities between noise segments of the modulated noise signal. That is to say, a would be interceptor is unable to determine where one symbol of the noise modulated signal begins and another ends, or even whether the noise modulation signal carries information.

In addition, the random nature of the noise records from which a modulated noise signal is derived engenders a transmitted analog signal which has a power spectrum that is time constant without periodicities, unlike the repeated nature of the signals according to the prior art which give rise to spectral lines resulting in the unnecessary loss of power. Thus, the present invention saves power and a would-be interceptor is unable to detect periodicities or other revealing features.

An additional advantage of the current invention is that noise communications offers several advantages relative to immunity to noise. In fact, a mathematical analysis indicates, when G noise samples per data symbol are transmitted, that receiver processing rejects interference and increases the signal-to-interference ratio by a factor of G+2.

With reference to FIG. 9, shown are multiple noise communications systems 100 which communicate in overlapping frequency bands. The present invention is advantageous in that multiple noise communications systems can occupy the same part of the frequency spectrum without substantially interfering with each other. Each noise communications system 100 operates using its own unique group of M individual noise records. The channels are labeled 0, 1, . . . , N−1. Thus, each noise communications system 100 includes a unique transmitter 103 and receiver 106 associated with a specific set of noise records. The N transmitters 103 are labeled transmitter 0, 1, . . . , N−1 and the N receivers are labeled receiver 0, 1, . . . , N−1 to correspond with the particular channel over which they transmit and receive the N base signals z(kT), which are correspondingly labeled $z_0(kT)$, $z_1(kT)$, . . . $z_{N-1}(kT)$.

Although each noise communications system 100 employs the same communications channel 143, the transfer function H(f,t) which represents the communications channel 143 with respect to the transmitted noise signals may differ as each noise communications system 100 may not operate under identical circumstances. For example, where the communications channel 143 is air, the transmitters 103 and receivers 106 may each be located in different positions with a different surrounding environment. Thus, the transfer functions encountered by the noise communications systems 100 are labeled $H_0(f,t)$, $H_1(f,t)$, . . . $H_{N-1}(f,t)$ to correspond with the particular channel. Likewise, the interference with the transmission of the noise signal across the communication channel 143 for each noise communications system 100 is unique for each channel and, thus, the interference waveforms for the channels are labeled $I_0(t)$, $I_1(t)$, . . . , $I_{N-1}(t)$.

Figure 10:
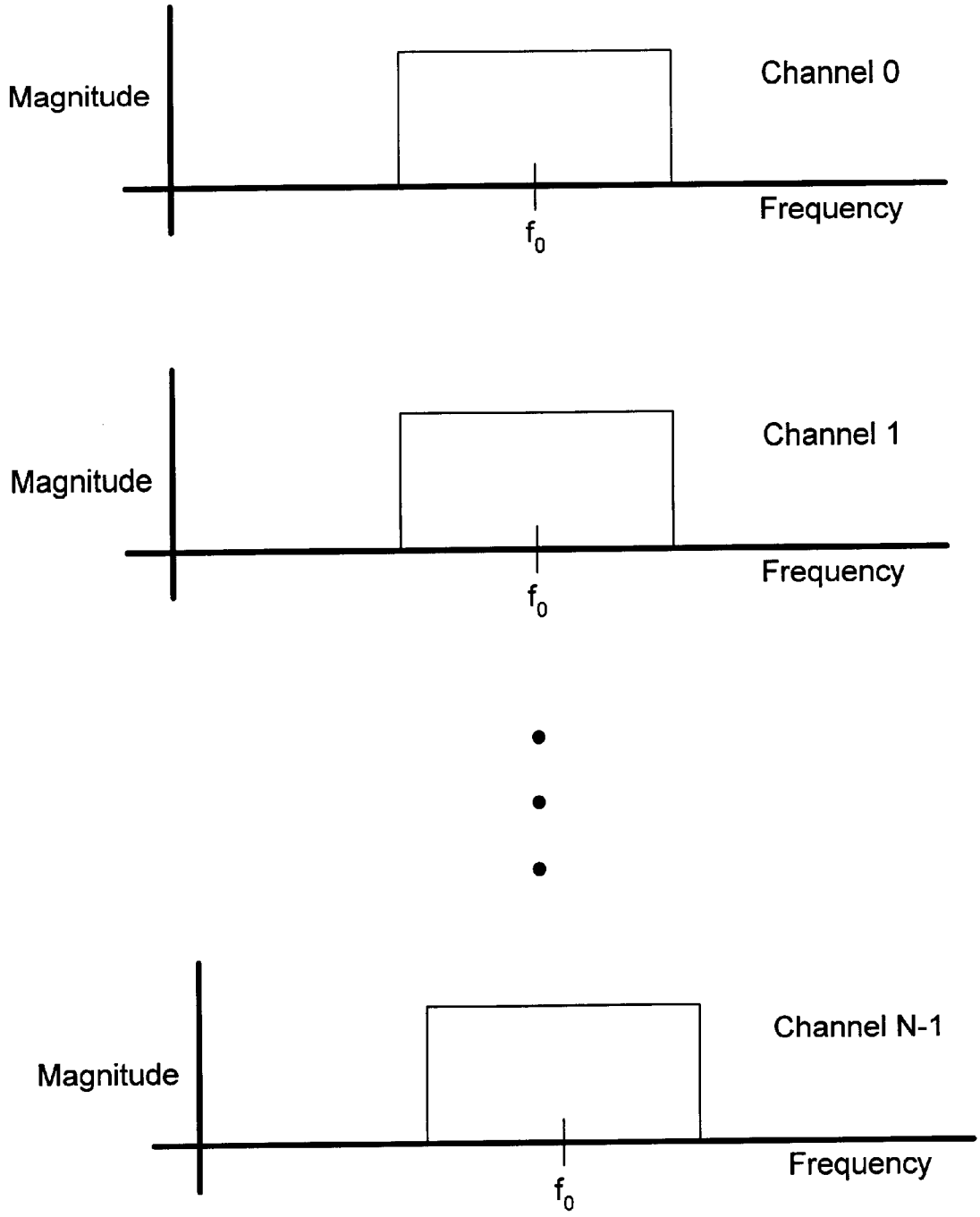
FIG. 10 shows graphs of the frequency bands of the multiple noise communication systems of FIG. 9.

Referring then, to FIG. 10, shown are the magnitudes of the power spectra of the noise modulated signals for each of the channels of the multiple noise communications systems 100 of FIG. 9. As shown, each noise communications system 100 for channels 0, 1, . . . , N−1 all transmit at the same center frequency $f_0$. Thus, the present invention features a distinct advantage in that a total of N multiple noise modulated communication signals may wholly or partially occupy the same band in the frequency spectrum without interfering with each other in such a way as to unacceptably degrade the performance of each noise communications system 100.

Turning back to FIG. 9, generally the function performed by the correlator 213 (FIG. 2) within each noise demodulator 209 for the various channels enables the base signal z(kT) for each channel to be reassembled in spite of the interference introduced by the other channels using the same frequency band. Thus, for each channel, the noise signal of the remaining channels is seen as interference I(t). For example, the noise signals of channels 1 through N−1 are the major contributors to the interference $I_0(t)$ for channel 0, etc. The actual number of channels that may occupy the same frequency spectrum as shown in FIG. 10 depends on the net effect the channels will have on each other. Specifically, as the number of channels that share a specific frequency band increases, then the correlation of a particular noise signal in a specific receiver 106 will result in a lesser peak when a match is experienced. When this peak is reduced to a point where it is not very distinguishable from those channels which have not experienced a peak, then the likelihood of error increases. Thus, there is a tradeoff between the number of channels that may occupy a specific frequency band and the error rate associated with each channel. The actual number of channels assigned to a particular frequency band is thus application specific, depending upon the desired error rate for the application and the width of the frequency band. Note that multiple adjacent frequency bands may be employed, each being shared by a predetermined number of channels if greater bandwidth is needed. Note also that employment of partially overlapping frequency bands is also possible.

Figure 11:
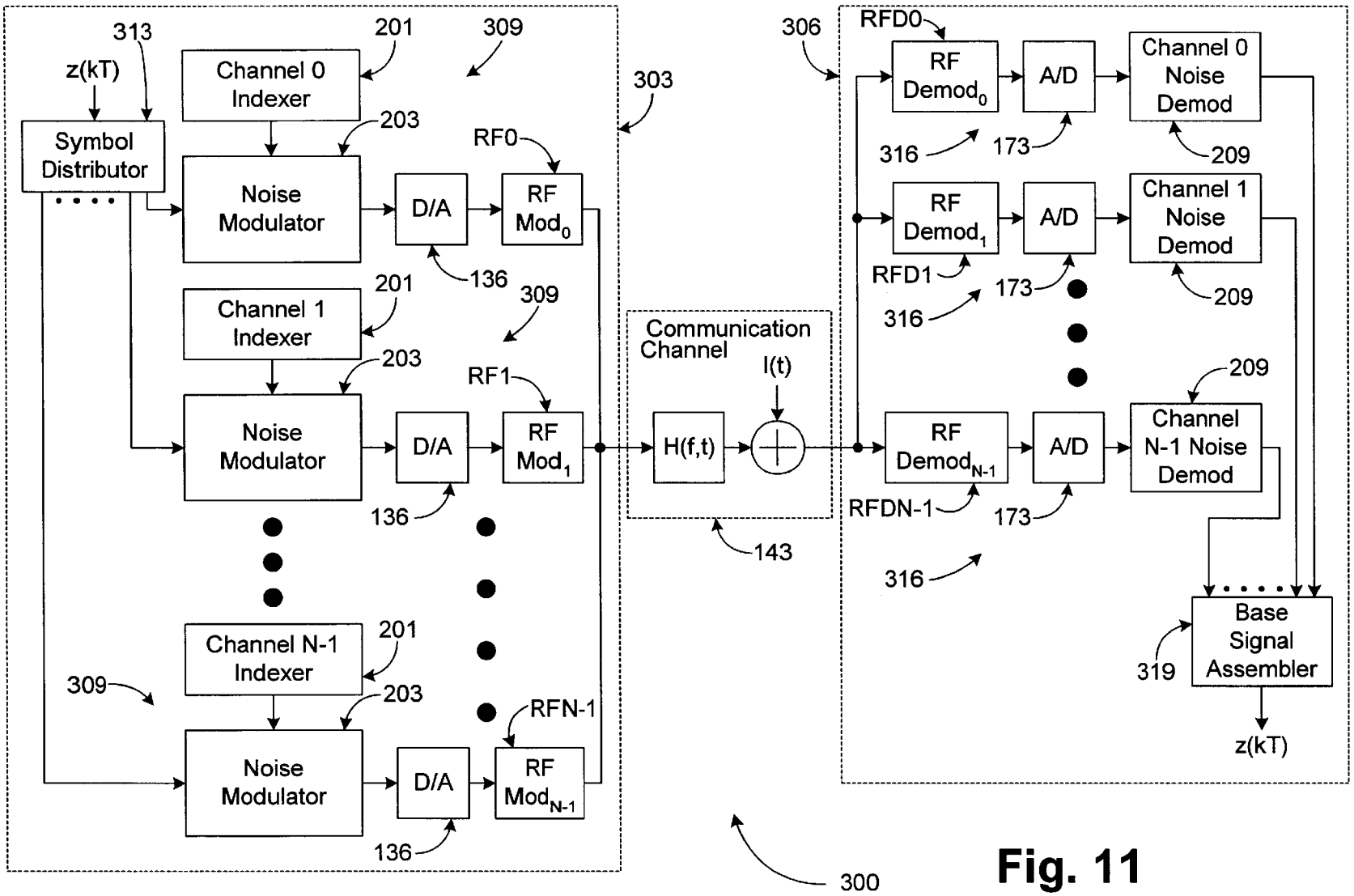
FIG. 11 is a functional block diagram of a multi-channel noise communications system according to another embodiment of the present invention.

Turning then to FIG. 11, shown is a functional block diagram of a multi-channel noise communications system 300 according to another embodiment of the present invention. The multi-channel noise communications system 300 includes a multi-channel transmitter 303 and a multi-channel receiver 306. The physical structure of the multi-channel transmitter 303 and the multi-channel receiver 306 may be similar to the structure of the transmitter 103 (FIG. 1) and receiver 106 (FIG. 1) discussed previously with reference to FIG. 1. Within the multi-channel transmitter 303 are individual transmitters 309 which modulate a specific channel and include an indexer 201, a noise modulator 203, and a D/A converter 136. The components of each of the transmitters 309 further include respective RF modulators RF0, RF1, . . . , RF(N−1). The multi-channel transmitter 303 also comprises a symbol distributor 313 (multiplexer) which has a base signal input which receives the base signal z(kT) which may comprise, for example, a stream of discrete symbols. The symbol distributor 313 receives the base signal and distributes the sequentially received symbols among each of the individual transmitters 309. Each individual transmitter 309 of the multi-channel transmitter 303 produces a noise modulated signal as discussed previously which is applied to the communications channel 143 having a transfer function H(f,t) and interference I(t).

The multi-channel receiver 306 includes individual receivers 316 which include respective RF demodulators RFD0, RFD1, . . . , and RFD(N−1), A/D converters 173, and noise demodulators 209 which are employed to demodulate the noise signal transmitted across each channel as discussed previously. The sample output of each of the individual receivers 316 are fed into a base signal assembler 319 which acts as a demultiplexer that reconstructs the digital base signal z(kT) from the signals received over the individual channels.

Figure 12:
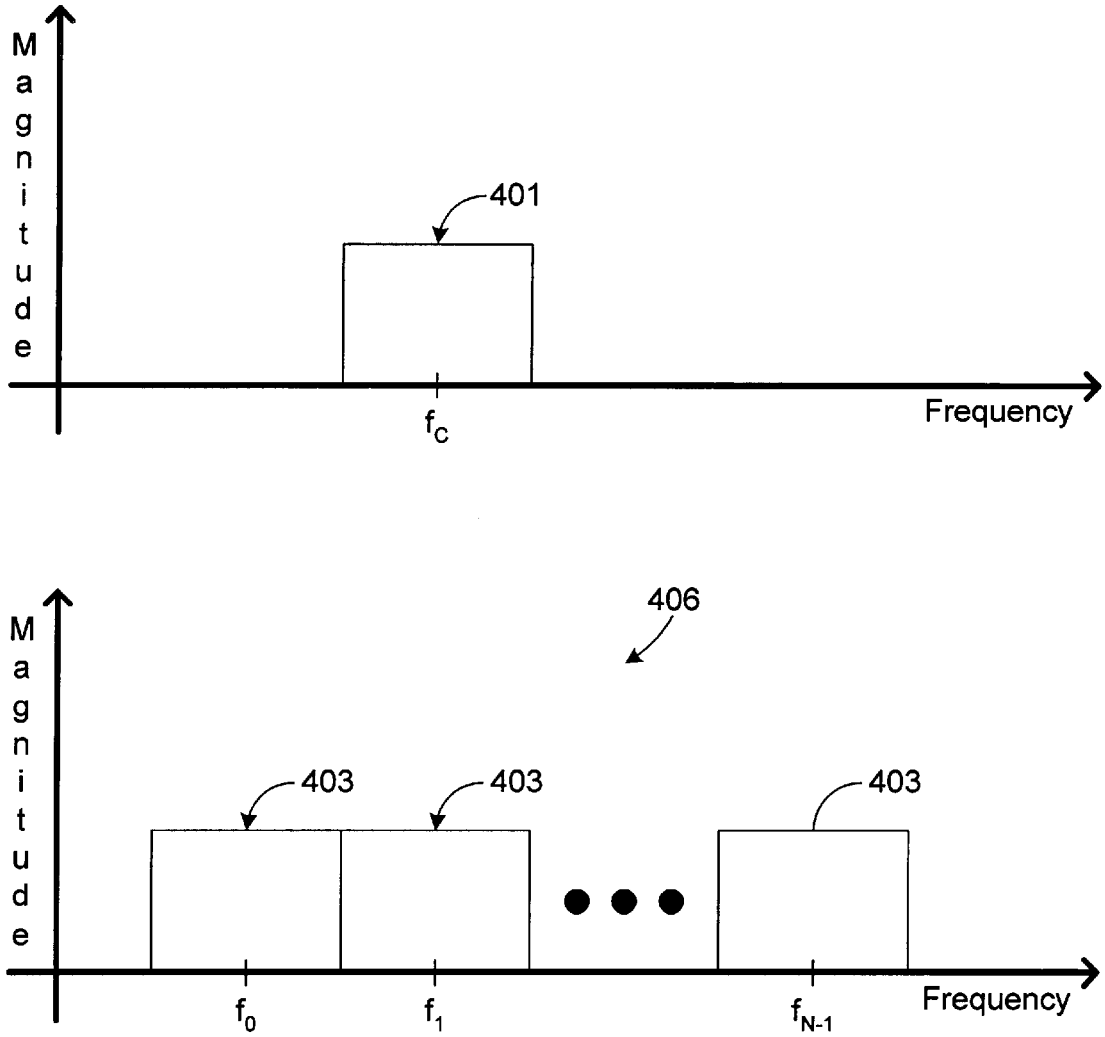
FIG. 12 shows graphs of the frequency bands that may be employed by the multi-channel noise communications system of FIG. 11.

With reference to FIG. 12, shown are graphs of the frequency bands that may be occupied by each of the channels 0, 1, . . . , N−1. In fact, the channels may occupy any combination of frequency bands. For example, all of the channels may occupy a single frequency band 401 subject to the channel quantity/error rate tradeoff previously discussed with reference to FIG. 9. Also, each channel may occupy separate frequency bands 403, or a combination of separate and shared frequency bands.

A number of advantages of noise communications pertain to the shape of the power spectrum of the RF analog signal radiated into the communication channel 143 (FIG. 2). This is particularly true multi-channel communications. In the frequency domain the power spectrum is dominated by the time domain shaping pulse p(t) that occurs in the sampling expansion representation of the output of the A/D converter 136. The sampling expansion for any noise waveform n(t) is given by the following equation:

$$\sum_{-\infty}^{+\infty} n(jT_{ss})p(t-jT_{ss})$$

Given reasonable mathematical assumptions about the shaping pulse p(t), the expansion above generates an analog signal of total bandwidth $2W_{SS}$ Hz where $W_{SS}=1/(2T_{SS})$. Particularly, when p(t) is equal to or approximates the Shannon interpolating pulse, i.e. when $$p(t)=\frac{\sin\pi\frac{t}{T_{ss}}}{\pi\frac{t}{T_{ss}}}$$

the power spectrum of the transmitted analog communication signal is flat across the $2W_{SS}$ bandwidth, dropping sharply at the edges. For the current invention, this implies an original, distinct and notable efficiency in the use of the spectral space available in the frequency domain.

As discussed subsequently in this application, the flat power spectrum of noise communication transmissions means that frequency division multiplexing (FDMA) may be employed for multi-user communications since different users occupying different frequency pass bands can be placed close to one another in the frequency domain without interfering with one another.

A distinct advantage accompanies the use of frequency multiplexing, i.e. Frequency Division Multiple Access (FDMA), that employs separate frequency bands 403 which are adjacent to each other. Specifically, when placed next to each other, the adjoined spectra in the different frequency bands 403 take on the appearance of the spectrum of a single noise communication signal of a total bandwidth equal to the sum of the bandwidths of the constituent parts, i.e. if the bandwidth of each component part is W, the total bandwidth is NW. Such adjacent frequency bands masquerading as a single spread spectrum is defined herein as a "pseudo spread spectrum" 406. To an outside observer who does not know the noise records used for each of the individual transmissions, none of the information carried by the individual communication signals that constitute the pseudo spread spectrum signal can be demodulated. In fact, to such an observer the transmission looks exactly like wide-band noise of total bandwidth NW.

The aforementioned frequency multiplexing scheme leading to the pseudo spread spectrum signal of FIG. 12 can be used in such a way as to offer some very distinct performance advantages. These performance advantages can be realized by using the symbol distributor 313 (FIG. 11) to distribute the same symbol to each of the individual channels and applying a majority vote decision process to the symbol outputs of the N noise demodulators 209 (FIG. 11). In the case of binary communications, for example, the base signal assembler 319 would examine the N binary outputs of the noise demodulators 209, and set z(kT)=0 if the majority of such outputs were "0" and set z(kT)=1 if the majority of such outputs were "1". When this approach is used, the pseudo spread spectrum signal, in addition to having the physical appearance of a wideband (bandwidth NW) noise communication signal in the propagation environment, offers the performance advantages of same, i.e. performs with the high gain of a noise communications system of bandwidth NW.

Thus, the frequency multiplexed pseudo spread spectrum signal offers an important alternative approach to achieving wideband noise communications. In contrast to the initially presented approach, which launches noise samples every $T_{SS}$seconds (FIG. 3) in order to achieve the desired spread spectrum bandwidth, each of the N channels in the pseudo spread spectrum approach, in order to achieve the same overall bandwidth, launches noise samples every $T_{SS}/N$ seconds, but because of the parallelism offered by the frequency channels, achieves the same error rate performance (provided the majority decision logic described above is used). When the primary technological or cost limitation on a particular implementation is the speed at which noise samples can be processed, D/A converted, and launched over the channel, this new means of implementation offers a solution whereby the same goal can be achieved with considerably slower processing speeds applied to lower bandwidth channels operating in parallel.

Many variations and modifications may be made to the above-described embodiments of the invention without departing substantially from the spirit and principles of the invention. All such modifications and variations are intended to be included herein within the scope of the present invention.

Therefore, having thus described the invention, at least the following is claimed:

1. A modulation apparatus, comprising:

a processor electrically coupled to a data bus;

a memory electrically coupled to the data bus;

operating logic stored in the memory to modulate a predefined base data signal comprising a stream of symbols from a predefined alphabet of symbols into a noise signal, the operating logic comprising:

logic to index through a plurality of predefined noise segments of at least two noise records, each noise record corresponding to a symbol from the predefined alphabet of symbols; and logic to modulate the base signal into the noise signal by replacing each of the symbols of the predefined base signal with one of the predefined noise segments from the noise record corresponding to each respective symbol.

2. The apparatus of claim 1, wherein the operating logic further comprises logic to generate the noise records according to a predetermined criterion.

3. The apparatus of claim 1, wherein:

the noise records further comprise a predetermined sequence of samples stored in memory; and the operating logic further comprises logic to access the noise records from the memory.

4. The apparatus of claim 2, wherein the operating logic further comprises logic to partition the noise records from at least one source record.

5. A modulation apparatus to modulate a predefined base data signal comprising a stream of symbols from a predefined alphabet of symbols into a noise signal, comprising:

a noise indexer configured to index through a plurality of predefined noise segments of at least two noise records, each noise record corresponding to a symbol from the predefined alphabet of symbols; and a noise modulator configured to modulate the predefined base signal into the noise signal by replacing each of the symbols of the predefined base signal with one of the predefined noise segments from the noise record corresponding to each respective symbol.

6. The apparatus of claim 5, further comprising a noise sample generator to generate the noise records according to a predetermined criterion.

7. The apparatus of claim 5, wherein each of the noise records further comprises a predetermined sequence of samples stored in a memory.

8. The apparatus of claim 6, wherein the noise records are partitioned from at least one source record.

9. A modulation apparatus to modulate a predefined base data signal comprising a stream of symbols from a predefined alphabet of symbols into a noise signal, comprising:

indexing means for indexing through a plurality of predefined noise segments of at least two noise records, each noise record corresponding to a symbol from the predefined alphabet of symbols; and modulating means for modulating the predefined base signal into the noise signal by replacing each of the symbols of the predefined base signal with one of the predefined noise segments from the noise record corresponding to each respective symbol.

10. The apparatus of claim 9, further comprising means for generating the noise records according to a predetermined criterion.

11. The apparatus of claim 9, wherein:

the noise records further comprise a predetermined sequence of samples stored in memory; and the apparatus further comprising means for accessing the noise records from the memory.

12. The apparatus of claim 9, further comprising means for partitioning the noise records from at least one source record.

13. A method for modulating a predefined base data signal comprising a stream of symbols from a predefined alphabet of symbols into a noise signal, comprising the steps of:

indexing through a plurality of predefined noise segments of at least two noise records, each noise record corresponding to a symbol from the predefined alphabet of symbols; and modulating the predefined base signal into the noise signal by replacing each of the symbols of the predefined base signal with one of the predefined noise segments from the noise record corresponding to each respective symbol.

14. The method of claim 13, further comprising the step of generating the noise records according to a predetermined criterion.

15. The method of claim 13, further comprising the step of accessing the noise records in a memory, the noise records further comprising predetermined sequences of samples stored in the memory.

16. The method of claim 13, further comprising the step of partitioning the noise records from at least one source record.

17. A demodulation apparatus, comprising:

a processor electrically coupled to a data bus;

a memory electrically coupled to the data bus;

operating logic stored in the memory to demodulate a predefined noise signal comprising a stream of noise signal segments into a base signal comprising a stream of symbols from a predefined alphabet of symbols, the operating logic comprising:

logic to index through a plurality of noise record segments of at least two predefined noise records, each noise record corresponding to a symbol from the predefined alphabet of symbols; and logic to demodulate the predefined noise signal by correlating each of the noise signal segments with the indexed noise record segments and determining a maximum correlation value for each of the noise signal segments, the maximum correlation value corresponding to one of the symbols of the predefined alphabet.

18. The apparatus of claim 17, wherein the operating logic further comprises logic to generate the noise records according to a predetermined criterion.

19. The apparatus of claim 17, wherein:

the noise records further comprise a predetermined sequence of samples stored in memory; and the operating logic further comprises logic to access the noise records from the memory.

20. The apparatus of claim 17, wherein the operating logic further comprises logic to partition the noise records from at least one source record.

21. A demodulation apparatus to demodulate a predefined noise signal comprising a stream of noise signal segments into a base signal comprising a stream of symbols from a predefined alphabet of symbols, comprising:

a noise indexer configured to index through a plurality of noise record segments of at least two predefined noise records, each noise record corresponding to a symbol from the predefined alphabet of symbols; and a noise demodulator configured to demodulate the predefined noise signal by correlating each of the noise signal segments with the indexed noise record segments and determining a maximum correlation value for each of the noise signal segments, the maximum correlation value corresponding to one of the symbols of the predefined alphabet.

22. The apparatus of claim 21, further comprising a noise sample generator to generate the noise records according to a predetermined criterion.

23. The apparatus of claim 21, wherein each of the noise records further comprises a predetermined sequence of samples stored in a memory.

24. The apparatus of claim 21, wherein the noise records are partitioned from at least one source record.

25. A demodulation apparatus to demodulate a predefined noise signal comprising a stream of noise signal segments into a base signal comprising a stream of symbols from a predefined alphabet of symbols, comprising:

an indexing means for indexing through a plurality of noise record segments of at least two predefined noise records, each noise record corresponding to a symbol from the predefined alphabet of symbols; and a demodulating means for demodulating the predefined noise signal by correlating each of the noise signal segments with the indexed noise record segments and determining a maximum correlation value for each of the noise signal segments, the maximum correlation value corresponding to one of the symbols of the predefined alphabet.

26. The apparatus of claim 25, further comprising means for generating the noise records according to a predetermined criterion.

27. The apparatus of claim 25, wherein:

the noise records further comprise a predetermined sequence of samples stored in a memory; and further comprising means for accessing the noise records from the memory.

28. The apparatus of claim 25, further comprising means for partitioning the noise records from at least one source record.

29. A method for demodulating a predefined noise signal comprising a stream of noise signal segments into a base signal comprising a stream of symbols from a predefined alphabet of symbols, comprising the steps of:

indexing through a plurality of noise record segments of at least two predefined noise records, each noise record corresponding to a symbol from the predefined alphabet of symbols; and demodulating the predefined noise signal by correlating each of the noise signal segments with the indexed noise record segments and determining a maximum correlation value for each of the noise signal segments, the maximum correlation value corresponding to one of the symbols of the predefined alphabet.

30. The method of claim 29, further comprising the step of generating the noise records according to a predetermined criterion.

31. The method of claim 29, further comprising the step of accessing the noise records in a memory, the noise records further comprising predetermined sequences of samples stored in the memory.

32. The method of claim 29, further comprising the step of partitioning the noise records from at least one source record.

33. A method of communicating a predefined base signal comprising a stream of symbols from a predefined alphabet of symbols from a transmitter to a receiver across a communication channel using noise, comprising:

indexing through a plurality of predefined noise segments of at least two noise records in the transmitter, each noise record corresponding to a symbol from the predefined alphabet of symbols;

modulating the predefined base signal into the noise signal by replacing each of the symbols of the predefined base signal with one of the predefined noise segments from the noise record corresponding to each respective symbol;

transmitting the noise signal from the transmitter to the receiver across the communication channel;

indexing through a plurality of noise record segments of at least two predefined noise records in the receiver, each noise record corresponding to a symbol from the predefined alphabet of symbols; and demodulating the noise signal by correlating each of the noise signal segments with the indexed noise record segments and determining a maximum correlation value for each of the noise signal segments, the maximum correlation value corresponding to one of the symbols of the predefined alphabet.

34. A multi-channel modulation apparatus, comprising:

a base signal distributor configured to distribute a stream of symbols of a predefined base signal among a number of channels, thereby creating a number of channel base signals;

an indexer associated with each of the channels configured to index a plurality of noise segments of at least two channel specific noise records to maintain a current noise segment for each of the channel specific noise records; and a modulator associated with each of the channels configured to modulate the respective channel base signal into a channel noise signal by replacing a current symbol of the channel base signal with the current noise segment from the channel specific noise record corresponding to the respective current symbol.

35. The apparatus of claim 34, further comprising a radio frequency modulator associated with each channel configured to modulate the respective channel noise signals to a predetermined channel frequency band.

36. The apparatus of claim 35, wherein the predetermined channel frequency bands overlap.

37. The apparatus of claim 35, wherein the predetermined channel frequency bands are adjacent to each other, thereby creating a continuous pass band.

38. A multi-channel demodulation apparatus, comprising:

an indexer associated with each of the channels configured to index a plurality of noise segments of at least two channel specific noise records to maintain a current noise segment for each of the channel specific noise records;

a demodulator associated with each of the channels configured to demodulate a respective channel noise signal into a channel base signal by correlating the current noise segments from each of the channel specific noise records with a current channel noise signal segment of the channel noise signal, and determining a maximum correlation value for each of the channel noise signal segments, the maximum correlation value corresponding to a symbol of a channel base signal; and a base signal assembler configured to combine the channel base signals into a base signal.

39. The apparatus of claim 38, further comprising a radio frequency demodulator associated with each channel configured to demodulate the respective channel noise signals from a plurality of predetermined channel frequency bands to a base band.

40. The apparatus of claim 38, wherein the predetermined channel frequency bands overlap.

41. The apparatus of claim 38, wherein the predetermined channel frequency bands are adjacent to each other, thereby creating a continuous pass band.

42. A multi-channel modulation apparatus, comprising:

a base signal distributor configured to provide a stream of symbols of a predefined base signal to a number of channels;

an indexer associated with each of the channels configured to index a plurality of noise segments of at least two channel specific noise records to maintain a current noise segment for each of the channel specific noise records;

a modulator associated with each of the channels configured to modulate the base signal into a channel noise signal by replacing a current symbol of the channel base signal with the current noise segment from one of the channel specific noise records corresponding to the respective current symbol; and a radio frequency modulator associated with each channel configured to modulate the respective channel noise signals to a number of predetermined, adjacent channel frequency bands, thereby creating a continuous pass band.

43. A multi-channel demodulation apparatus, comprising:

an indexer associated with each of the channels configured to index a plurality of noise segments of at least two channel specific noise records to maintain a current noise segment for each of the channel specific noise records;

a demodulator associated with each of the channels configured to demodulate a respective channel noise signal into a channel base signal by correlating the current noise segments from each of the channel specific noise records with a current channel noise signal segment of the channel noise signal, and determining a maximum correlation value for each of the channel noise signal segments, the maximum correlation value corresponding to one of a predetermined number of symbols in a predetermined alphabet, thereby providing a symbol indication for the channel; and a base assembler configured to determine a current symbol of a base signal by ascertaining a majority of the symbol indications provided by the channels.

* * * * *